US009126788B2

(12) United States Patent
Ishikura

(10) Patent No.: US 9,126,788 B2
(45) Date of Patent: Sep. 8, 2015

(54) IMAGE FORMING APPARATUS

(71) Applicant: Oki Data Corporation, Tokyo (JP)

(72) Inventor: Hiroki Ishikura, Tokyo (JP)

(73) Assignee: Oki Data Corporation, Tokyo (JP)

( * ) Notice: Subject to any disclaimer, the term of this patent is extended or adjusted under 35 U.S.C. 154(b) by 15 days.

(21) Appl. No.: 13/870,228

(22) Filed: Apr. 25, 2013

(65) Prior Publication Data

US 2013/0285317 A1 Oct. 31, 2013

(30) Foreign Application Priority Data

Apr. 26, 2012 (JP) ..... 2012-100717

(51) Int. Cl.

| | |
|---|---|
| ***B65H 1/22*** | (2006.01) |
| ***B65H 1/26*** | (2006.01) |
| ***B65H 9/08*** | (2006.01) |
| ***B65H 1/00*** | (2006.01) |

(52) U.S. Cl.

CPC ..... *B65H 1/266* (2013.01); *B65H 1/00* (2013.01); *B65H 9/08* (2013.01); *B65H 2402/61* (2013.01); *B65H 2402/64* (2013.01); *B65H 2403/513* (2013.01); *B65H 2405/113* (2013.01); *B65H 2405/31* (2013.01)

(58) Field of Classification Search

CPC ..... B65H 1/266; B65H 1/26; B65H 2405/31; B65H 1/04; B65H 2402/61; B65H 6402/64; B65H 2405/113; G03G 15/6502

USPC ..... 271/145, 162, 164

See application file for complete search history.

(56) References Cited

U.S. PATENT DOCUMENTS

| | | | | |
|---|---|---|---|---|
| 8,002,269 | B2 * | 8/2011 | Asada et al. | 271/145 |
| 8,684,348 | B2 * | 4/2014 | Matsuyama et al. | 271/164 |
| 2006/0180996 | A1 * | 8/2006 | Iwase et al. | 271/162 |
| 2012/0126475 | A1 * | 5/2012 | Shin et al. | 271/117 |

FOREIGN PATENT DOCUMENTS

JP 2003-276868 A 10/2003

* cited by examiner

*Primary Examiner* — Prasad Gokhale

(74) *Attorney, Agent, or Firm* — Muncy, Geissler, Olds & Lowe, P.C.

(57) ABSTRACT

An image forming apparatus includes an engagement member provided on a sheet supply cassette, a biasing member with a first part, a second part and an elastic part formed of elastic material. The first and second parts are linked with the elastic part. The second part is supported to a apparatus main body with a swing shaft. The first part engaging with the engagement member so that the biasing member maintains a compressed state by the engagement member, and a guide restriction member provided on the apparatus main body restrict a movement of the first part.

20 Claims, 20 Drawing Sheets

IMAGE FORMING APPARATUS

CROSS REFERENCE TO RELATED APPLICATION

The present application is related to, claims priority from and incorporates by reference Japanese Patent Application No. 2012-100717, filed on Apr. 26, 2012.

TECHNICAL FIELD

The present invention relates to an image forming apparatus such as a photocopy machine, a printer and the like, especially to an image forming apparatus that includes a sheet supply cassette.

BACKGROUND

Conventionally, when a sheet supply cassette is installed to an image forming apparatus main body in such a image forming apparatus, a user pushes the sheet supply cassette in the apparatus to install the sheet supply cassette at a predetermined position in the image forming apparatus main body (e.g. see JP Laid-Open Patent Application No. 2003-276868, page 4, FIG. 6).

However, when the sheet supply cassette is installed to the image forming apparatus described above, force of the user to push the sheet supply cassette is insufficient and the user cannot install the sheet supply cassette securely.

SUMMARY

An image forming apparatus disclosed in the present application, in which a sheet supply cassette configured to stack recording media thereon slidably moves in an installation direction and a pull-out direction so that the sheet supply cassettes changes its position between a pull-out position where the sheet supply cassette is pulled out from an apparatus main body and an installation position where the sheet supply cassette is installed to the apparatus main body, includes: an engagement member provided on the sheet supply cassette; a biasing member that is configured with a first part, a second part and an elastic part formed of an elastic material, the first and second parts being linked with the elastic part, the second part being supported to the apparatus main body with a swing shaft such that the second part swings around the swing shaft, the first part engaging with the engagement member so that the biasing member maintains a compressed state by the engagement member; and a guide restriction member provided on the apparatus main body and configured to restrict a movement of the first part in the installation direction and the pull-out direction.

According to the present invention, when the sheet supply cassette is installed to the installation position, the sheet supply cassette is always stabilized in the installation position regardless the force of the user to push the sheet supply cassette.

BRIEF DESCRIPTION OF THE DRAWINGS

In the attached drawings:

FIG. 9A shows the wait status, FIG. 9B shows a dead center position status, and FIG. 9C shown an installation status.

DESCRIPTION OF EMBODIMENTS

First Embodiment

Figure 1:
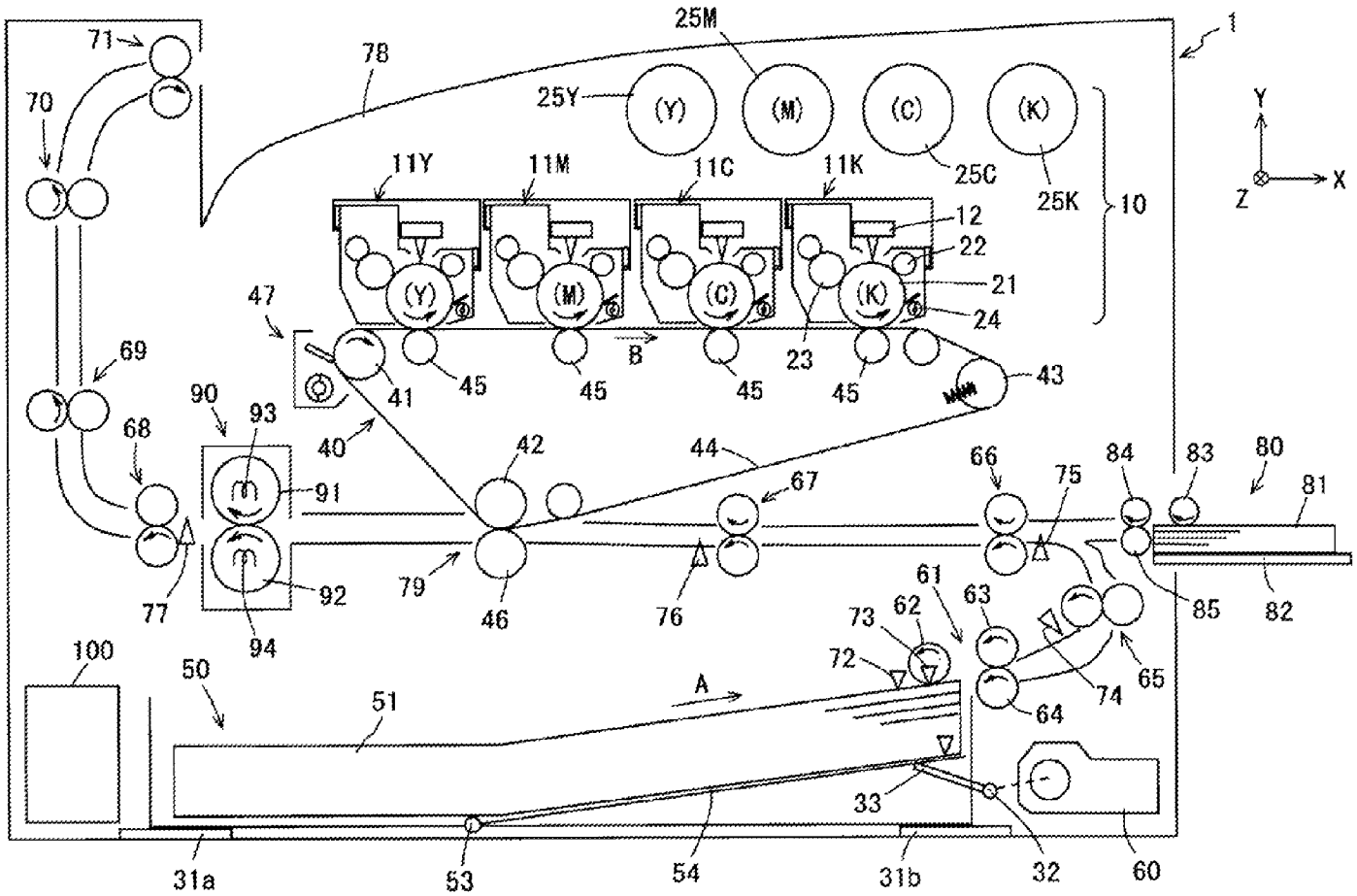
FIG. 1 is a schematic diagram of a main configuration of an image forming apparatus according to a first embodiment of the present invention.

FIG. 1 is a schematic diagram of a main configuration of an image forming apparatus according to a first embodiment of the present invention.

Figure 2:
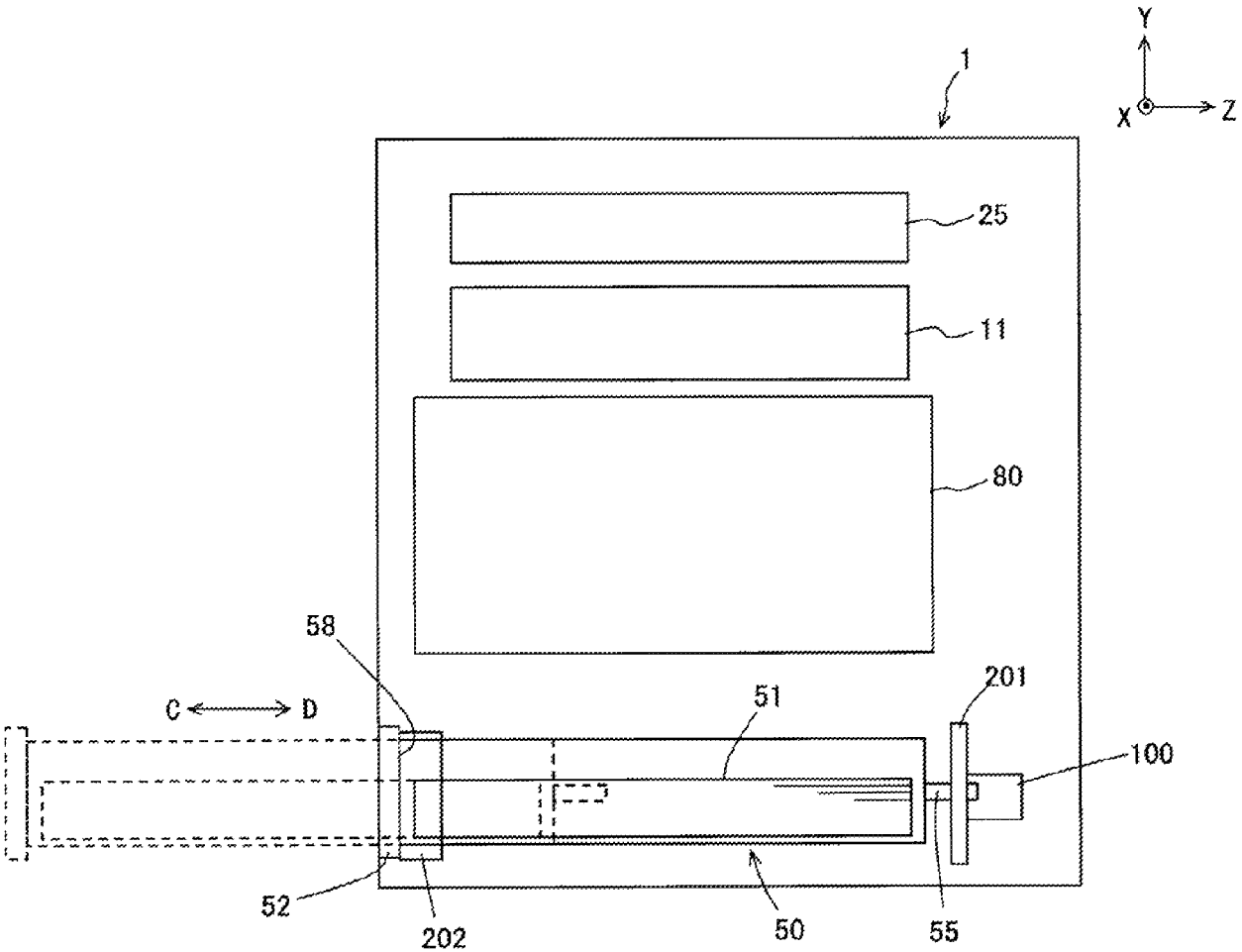
FIG. 2 is an operation explanatory diagram of the image forming apparatus according to the first embodiment seen from right side (X axis plus side)

In FIG. 1, the sheet supply cassette 50 accommodates recording sheets 51 as recording mediums staked therein. The sheet supply cassette 50 is slidably held between an installation position and a pull-out position that are illustrated in FIG. 2 in an image forming apparatus 1 main body by holders 31*a* and 31*b* as discussed later. A main body in which movable configuration elements as the sheet supply cassette 50 of the image forming apparatus 1 are removed may be referred to as the image forming apparatus 1 main body. An installation status of the sheet supply cassette 50 in which the sheet supply cassette 50 is in an installation position as illustrated in FIG. 1 and other statuses than the installation status may merely be referred to as installation and removal.

A sheet stacking plate 54 is provided in the sheet supply cassette 50. The sheet stacking plate 54 is swingably supported by a support shaft 53. The recording sheets 51 stacks on the sheet stacking plate 54. A lift-up lever 33 is rotatably linked to a support shaft 32 on a sheet feeding side of the sheet supply cassette 50. The support shaft 32 is engaged with a motor 60 to contact and separate from the motor 60 in response to the installation and removal of the sheet supply cassette 50. The motor 60 is controlled to rotate by a controller (not illustrated). Rotation of the motor 60 is transmitted to the support shaft 32 when the sheet supply cassette 50 is installed.

When the lift-up lever 33 rotates, a front edge part of the lift-up lever 33 lifts a bottom part of the sheet stacking plate 54. Thereby, the recording sheets 51 that stack on the sheet stacking plate 54 are raised. A raise detection part 73 detects the recording sheets 51 that are raised to a certain height and abut on the pickup roller 62. A controller (not illustrated) stops the rotation of the motor 60 based on information that the raise detection part 73 detects. A pickup roller 62, a feed roller 63 and a retard roller 64 configures a sheet feeding part 61. The feed roller 63 and the retard roller 64 are in a contact with and arranged to face each other.

The pickup roller 62 and the feed roller 63 are driven to rotate in arrow directions by a motor (not illustrated), and the feed roller 63 includes a one-way clutch mechanism (not illustrated) therein. Thus, the pickup roller 62 and the feed roller 63 idle in the arrow directions even when the motor stops rotating the pickup roller 62 and the feed roller 63. Moreover, the retard roller 64 generates torque in the arrow direction by a torque generation device (not illustrated). The arrow direction is different from a direction in which the retard roller 64 is driven and rotated by the feed roller 63. Accordingly, the pickup roller 62 picks up the recording sheet 51 that abuts on the pickup roller 62 from the inside of the sheet supply cassette 50. The feed roller 63 and the retard roller 64 feed each of the recording sheets 51 to a carrying path in order even if the plurality of sheets 51 are simultaneously picked up, for example.

A sheet sensor 74, a pair of carrying rollers 65, a sheet sensor 75, pairs of carrying rollers 66 and 67 and a writing sensor 76 are sequentially arranged on the downstream side of the sheet feeding part 61 in the arrow A direction. The arrow A indicates a carrying direction of the recording sheet 51. The pair of carrying rollers 65 correct skew of the recording sheet 51. The sheet sensor 75 detects the timing for driving the pair of carrying rollers 66 next to the sheet sensor 75. The pairs of carrying rollers 66 and 67 send the recording sheet 51 to a secondary transfer part 79. The writing sensor 76 detects the timing for writing in the image forming part 10. Power is transmitted to the pairs of carrying rollers 65, 66 and 67 from a carrying driving motor (not illustrated) via driving transmission parts such as gears and the like (not illustrated).

A multipurpose tray (MPT) 80 is provided on the right side surface of the image forming apparatus 1 in FIG. 1. The MPT 80 feeds recording sheets 81 stacked on the sheet stacking plate 82. The MPT 80 includes a sheet stacking plate 82, a pickup roller 83, a sheet supply roller 84, and a retard roller 85 and the like. The sheet stacking plate 82 stacks the recording sheets 81. The pickup roller 83 contacts and feeds the recording sheet 81. The sheet supply roller 84 sends the fed sheet 81 to the carrying path of the image forming apparatus 1 main body. The retard roller 85 is biased by and abuts on the sheet supply roller 84 to separate the sheets one by one.

The image forming part 10 includes four process units 11Y, 11M, 11C and 11K (may merely be referred to as a process unit 11 if not necessary to be especially distinguished). The process units 11Y, 11M, 11C and 11K form yellow (Y), magenta (M), cyan (C) and black (K) toner images (developer images), respectively. The process units 40Y, 40M, 40C, 40K are arranged sequentially from the upstream side of a later-discussed intermediate transfer belt 44 of an intermediate transfer belt unit 40 in the arrow B direction. The arrow B indicates a movement direction in which the intermediate transfer belt 44 moves above the intermediate transfer belt unit 40.

Internal configurations of the process units 11 are same. Therefore, an internal configuration of the black process unit 11K is explained as an example.

The photosensitive drum 21 is arranged in the process unit 11K to rotate in an arrow direction. A charge roller 22 and an exposure device 12 are arranged on the circumference of the photosensitive drum 21 sequentially from the upstream side of the rotation direction of the photosensitive drum 21. The charge roller 22 supplies electric charges on and charges the surface of the photosensitive drum 21. The exposure device 12 selectively irradiates the surface of the charged photosensitive drum 21 with light to form an electrostatic latent image on the surface of the photosensitive drum 21.

Moreover, a development roller 23 and a drum cleaning part 24 are arranged on the surface of the photosensitive drum 21 on which the electrostatic latent image has been formed. The development roller 23 attaches black toner to the electrostatic latent image to develop the electrostatic latent image. The cleaning part 24 removes transfer residual toner that remains on the photosensitive drum 21 after a toner image on the photosensitive drum 21 has been transferred. A toner containing part 25K contains toner and provides the toner on the development roller 23. Power is transmitted to the drum and the roller used in each of the process units from a driving source (not illustrated) via gears and the like (not illustrated). Thereby, the drum and the roller rotate.

The intermediate transfer belt unit 40 includes a driving roller 41, a tension roller 43, a secondary transfer backup roller 42 and the intermediate transfer belt 44. The driving roller 41 is driven by a driving part (not illustrated). The tension roller 43 gives tension to the intermediate transfer belt 44 with a biasing part such as a coil spring. The secondary transfer backup roller 42 is arranged to face a secondary transfer roller 46, and configures a secondary transfer part 79. The intermediate transfer belt 44 is strained by the rollers. Moreover, the intermediate transfer belt unit 40 is arranged to face a belt cleaning part 47 and the photosensitive drum 21 of each process unit 11. The belt cleaning part 47 removes toner that remains on the intermediate transfer belt 44. Furthermore, the intermediate transfer belt unit 40 includes four primary transfer rollers 45 and the like. A predetermined voltage is applied to the primary transfer rollers 45 so that the primary transfer rollers 45 transfer the toner images in the respective colors, which have been formed on the respective photosensitive drums 21, sequentially over each other on the intermediate transfer belt 44.

The intermediate transfer belt unit 40 transfers the above-discussed toner image, which has been formed by the image forming part 10, onto the intermediate transfer belt 44. Furthermore, the intermediate transfer belt unit 40 transfers the toner image onto the recording sheet 51 fed from the sheet supply cassette 50 or the recording sheet 81 fed from the MPT 80 at the secondary transfer part 79.

A fuser part 90 includes a pair of an upper roller 91 and a lower roller 92. The upper roller 91 includes a halogen lamp (heat source) 93 therein, and includes a surface formed of an elastic member. The lower roller 92 includes a halogen lamp (heat source) 94 therein, and includes a surface formed of an elastic member in the same manner as the upper roller 91. The fuser part 90 applies heat and pressure to the toner image on the recording sheet 51 (or 81) sent by the secondary transfer part 79, and fuses the toner image to fix the toner image on the recording sheet 51 (or 81).

After that, the recording sheet 51 (81) is carried and ejected on a stacker part 78 by pairs of ejection rollers 68, 69, 70 and 71. Power is transmitted to the pairs of ejection rollers from a driving source (not illustrated) via driving transmission parts (not illustrated). A sheet sensor 77 is arranged at an output part of the fuser part 90. The sheet sensor 77 detects the timing for driving the pairs of ejection rollers 68, 69, 70 and 71.

Each of the axes X, Y and Z in FIG. 1 extend as follows: the X axis extends in a carrying direction (the arrow B direction) in which the intermediate transfer belt 44 passes the process units 11; the Z axis extends in a rotational axial direction around which the photosensitive drum 21 rotates; and the Y axis extends in a direction orthogonal to both of the axes described above. When the axes X, Y, and Z are illustrated in later-discussed other drawings, the directions of the axes illustrate the same directions. Namely, the X, Y, and Z axes in the drawings illustrate directions in which parts depicted in the drawings are arranged when the parts configure the image forming apparatus 1 illustrated in FIG. 1. The parts are arranged so that the Y axis extends in a substantially vertical direction.

FIG. 2 illustrates an operation explanatory diagram of the image forming apparatus 1 according to the present embodiment seen from right side (X axis plus side).

As illustrated in FIG. 2, the sheet supply cassette 50 is held between the pull-out position and the installation position by the holders 31*a* and 31*b* described above (FIG. 1) so that the sheet supply cassette 50 slides in the arrow C direction (pull-out direction) and D direction (installation direction) along the Z axis. The pull-out position is in the lower part of the image forming apparatus 1 main body. The recording sheets 51 are refilled in the sheet supply cassette 50 when the sheet supply cassette 50 is at the pull-out position (illustrated by dotted lines in FIG. 2). The installation position (illustrated by solid lines in FIG. 2) is a position in which the recording sheets 51 are carried from the sheet supply cassette 50 by the sheet feeding part 61 when the sheet supply cassette 50 is installed to the image forming apparatus 1. The sheet supply cassette 50 includes a cassette cover 52. A front surface of the cassette cover 52 faces a user, and the cassette cover 52 is fixed to the sheet supply cassette main body. The user grabs the cassette cover 52, slides and moves the sheet supply cassette 50.

A fixing member 201 is arranged on the downstream side of the installation direction (arrow D direction) of the sheet supply cassette 50. The fixing member 201 is fixed to the image forming apparatus 1 main body. The fixing member 201 is provided with a pull-in part 100. As discussed later, the pull-in part 100 guides and bias in the installation direction (arrow D direction) an engagement member 55 when the sheet supply cassette 50 moves in the installation direction. The engagement member 55 extends from a rear edge part of the sheet supply cassette 50. As shown in FIG. 2, the engagement member 55 is positioned at a downstream end part in the installation direction (D) of the sheet supply cassette.

Figure 3B:
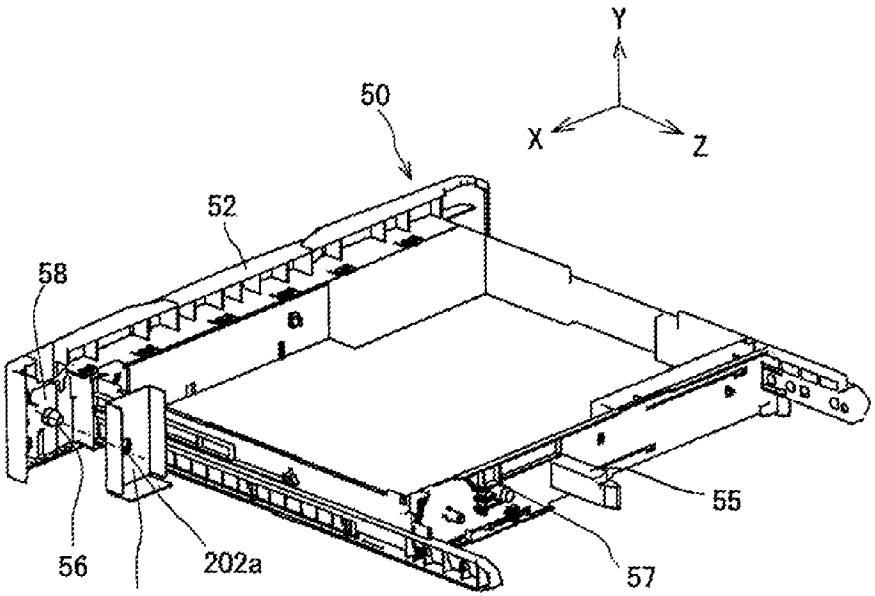
FIG. 3B is a perspective view of the configuration of the sheet supply cassette according to the first embodiment.
Figure 3A:
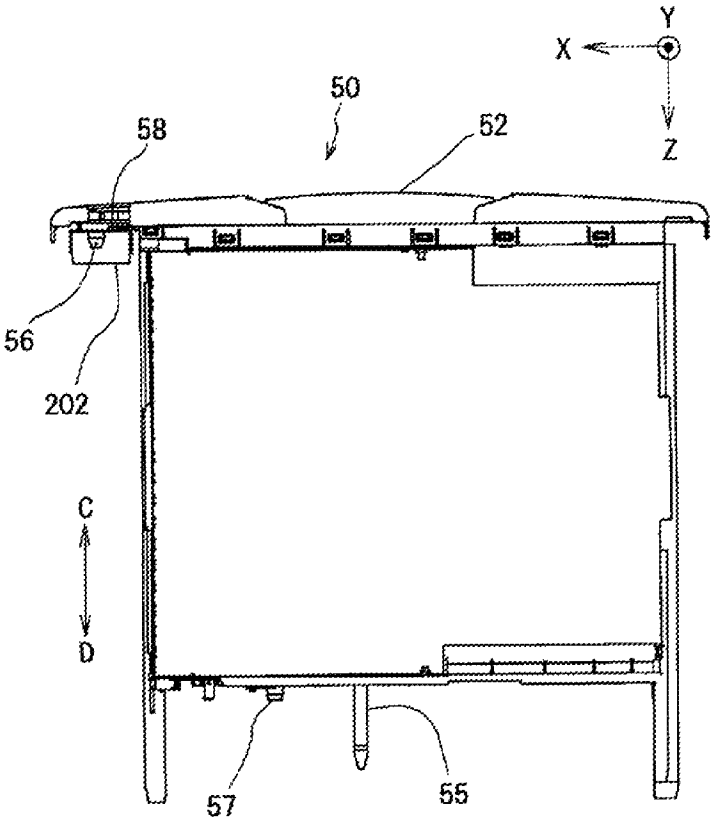
FIG. 3A is a plain view of a configuration of a sheet supply cassette according to the first embodiment.

FIG. 3A is a plain view of a configuration of the sheet supply cassette 50 according to the present embodiment. FIG. 3B is a perspective view of the configuration of the sheet supply cassette 50 according to the present embodiment.

The cassette cover 52 that the user grips includes an installation positioning surface 58. The installation positioning surface 58 abuts on an abutment part 202 fixed on the image forming apparatus 1 main body. Thereby, the sheet supply cassette 50 is positioned at the installation position in the installation direction (arrow D direction along the Z axis). A cassette cover post 56 is inserted into an engagement hole 202*a* of the abutment part 202, and a cassette post 57 is inserted into an engagement hole (not illustrated) formed at a position that corresponds to the fixing member 201 (FIG. 2) fixed to the image forming apparatus 1 main body. Thereby, the sheet supply cassette 50 is positioned at the installation position in the X axis direction. The later-discussed engagement member 55 is formed on a rear surface of the sheet supply cassette 50 on the downstream of the installation direction to project from the rear surface toward the downstream side of the arrow D direction.

Figures 4A, 4B:
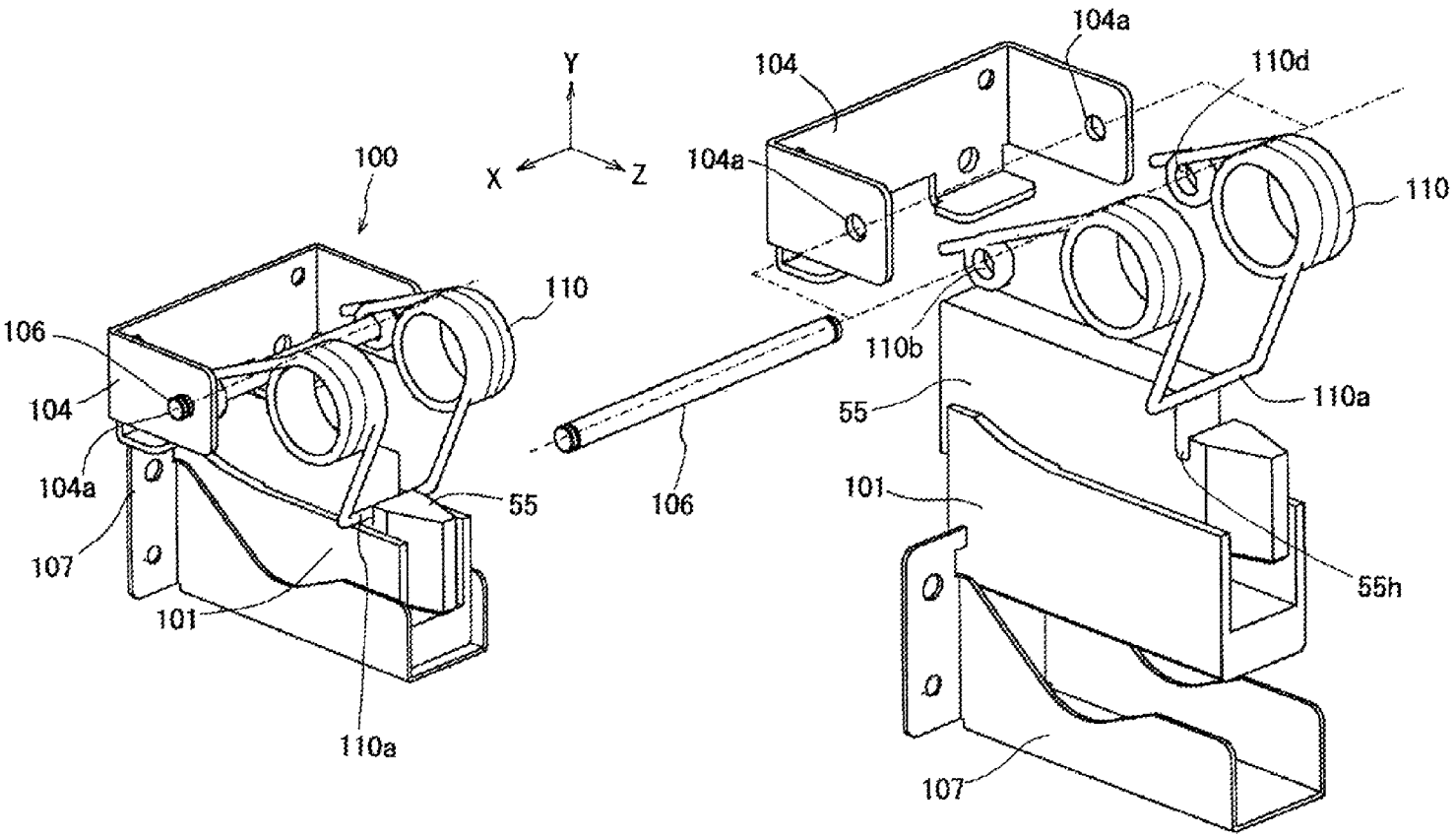
FIG. 4A is a perspective view of configurations of an engagement member and a pull-in part according to the first embodiment.
FIG. 4B is an exploded perspective view of the configurations of the engagement member and the pull-in part according to the first embodiment.

FIG. 4A is a perspective view of configurations of the engagement member 55 and the pull-in part 100 according to the first embodiment. FIG. 4B is an exploded perspective view of the configurations of the engagement member 55 and the pull-in part 100 according to the first embodiment.

In FIG. 4, a swing support member 104 and a guide support member 107 formed in a C-shape are fixed to the fixing member 201 (see FIG. 2) fixed to the image forming apparatus 1 main body. A spring shaft 106 is fixed to a pair of shaft holes 104*a* of the swing support member 104 that face each other. A later-discussed double torsion coil spring 110 as a biasing member is rotatably supported by the spring shaft 106. A later-discussed guide member 101 is fixed to the guide support member 107. As discussed later, the guide member 101 guides an engagement part 110*a* of the double torsion coil spring 110. The engagement part 110*a* engages with the engagement member 55 of the sheet supply cassette 50. The engagement member 55 moves in a groove part of the guide member 101. Here, the fixing member 201, the guide support member 107 and the guide member 101 correspond to guide restriction members.

Figure 5A:
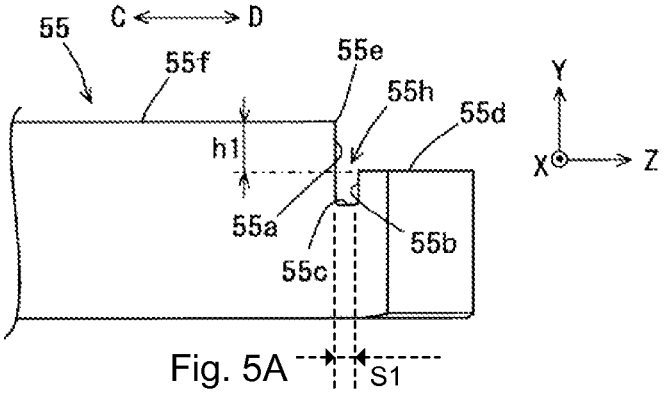
FIG. 5A is a front view of the configuration of the engagement member according to the first embodiment.
Figure 5B:
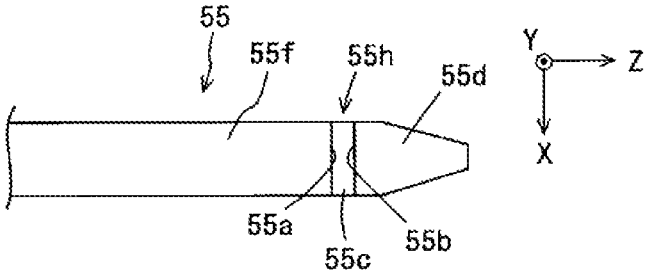
FIG. 5B is a plain view of the configuration of the engagement member according to the first embodiment.
Figure 5C:
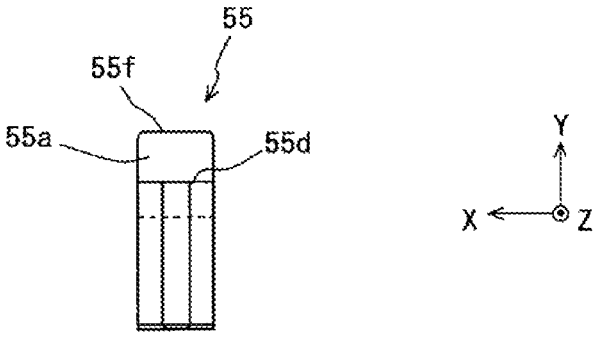
FIG. 5C is a side elevation view of the configuration of the engagement member according to the first embodiment from right side.

FIG. 5A is a front view of the configuration of the engagement member 55. FIG. 5B is a plain view of the configuration of the engagement member 55. FIG. 5C is a side elevation view of the configuration of the engagement member 55 from right side. As illustrated in FIG. 4, the engagement member 55 is formed to protrude from the rear surface of the sheet supply cassette 50 on the downstream of the installation direction.

As illustrated FIGS. 5A to C, the engagement member 55 is a substantially cuboid member that extends in the Z axis direction. A groove part 55*h* is formed in the upper side of the engagement member 55 in the vicinity of the front edge part thereof in a width direction (X axis direction). The groove part 55*h* is formed between an upper flat surface 55*f* and an upper flat surface 55*d*. The upper flat surface 55*f* is formed on the engagement member 55 on the arrow C side (sheet supply cassette 50 side). The upper flat surface 55*d* is formed on the engagement member 55 on the arrow D side (front edge side of the engagement member 55). The upper flat surface 55*d* is a predetermined distance h1 lower than the upper flat surface 55*f*. Wedge-shaped both sides of the engagement member 55 in the front edge side narrow along the front edge thereof. An engagement surface 55*a* (first surface) of the groove part 55*h* is a wall on the arrow C side. An engagement surface 55*b* (second surface) of the groove part 55*h* is a wall on the arrow D side. The engagement surfaces 55*a* and 55*b* face each other through a bottom part 55*c* therebetween, and are formed vertically to the Z axis. As discussed later, when the engagement member 55 moves, the engagement surfaces 55*a* and 55*b* engage with the engagement part 110*a* of the double torsion coil spring 110. The engagement part 110*a* and the engagement surfaces 55*a* and 55*b* act on each other. More specifically, the engagement surface 55*a* (or a first surface) guides the engagement part 110*a* (or a first part) toward the groove part 55*h*. Herein, the groove 55*h* is formed with the engagement surface 55*a*, the engagement surface 55*b* that is disposed facing the engagement surface 55*a* with a predetermined space S1, and the engagement surface 55*c* that unites the engagement surface 55*a* to the engagement surface 55*b*. The engagement surface 55*a* is disposed at an upstream side in Z-direction. The engagement surface 55*b* is disposed at a downstream side in Z-direction. The space S1 is greater than a diameter of the first part 110*a*. The engagement surfaces 55*a* and 55*b* extend in a direction (Y direction) that is substantially perpendicular to Z direction and X direction. Z direction means a direction along which the sheet supply cassette 50 moves. X direction means a direction along which the spring shaft 106 extends, the spring shaft 106 functioning as a swing shaft around which the bias member 110 swings. The "substantially perpendicular" means a range from plus and minus 10 degrees in Y direction.

Figure 6A:
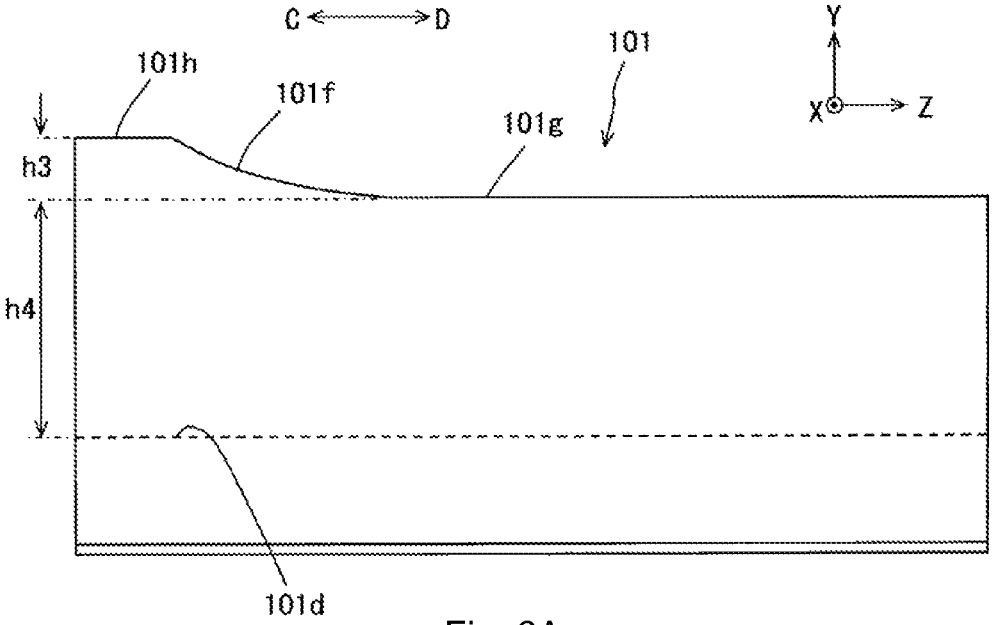
FIG. 6A is a front view of a configuration of a guide member according to the first embodiment.
Figure 6B:
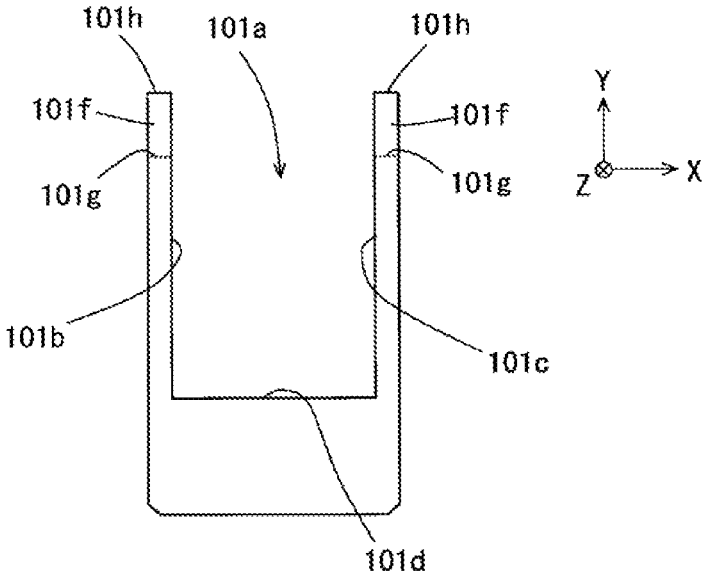
FIG. 6B is a side elevation view of the configuration of the guide member according to the first embodiment from left side.

FIG. 6A is a front view of a configuration of the guide member 101. FIG. 6B is a side elevation view of the configuration of the guide member 101 from left side. As illustrated in FIG. 4, the guide member 101 is fixed to and held by the guide support member 107.

As illustrated in FIG. 6B, the guide member 101 includes a cross-sectional surface formed in a C-shape. The left and right guide walls 101*b* and 101*c* as well as the bottom part 101*d* of the guide member 101 form a groove part 101*a*. The engagement member 55 that moves in the arrow D direction inserts into the groove part 101*a* when the sheet supply cassette 50 moves in the installation direction. The engagement member 55 moves on the bottom part 101*d* while the left and right guide walls 101*b* and 101*c* restricts the engagement member 55.

The guide walls 101*b* and 101*c* are opposed to and symmetrically formed with respect to each other. The guide walls 101*b* and 101*c* include a first horizontal part 101*g*, a second horizontal part 101*h* and an incline part 101*f*, respectively. An upper surface of each first horizontal part 101*g* is formed at a h4 height from the bottom part 101*d*, and extends from an edge part on the arrow D direction to a position in which the first horizontal part 101*g* exceed a center part. The second horizontal part 101*h* is formed near an edge part on the arrow C direction and at a height a distance h3 higher than the first horizontal part 101*g*. The incline part 101*f* is formed between the first horizontal part 101*g* and the second horizontal part 101*h*. The incline part 101*f* includes a gentle incline surface that connects both of the horizontal parts 101*g* and 101*h*. Herein, the incline part 101*f* functions as a guiding part, the first horizontal part 101*g* as a first restrict part, the second horizontal part 101*h* as a second restrict part.

Figure 7A:
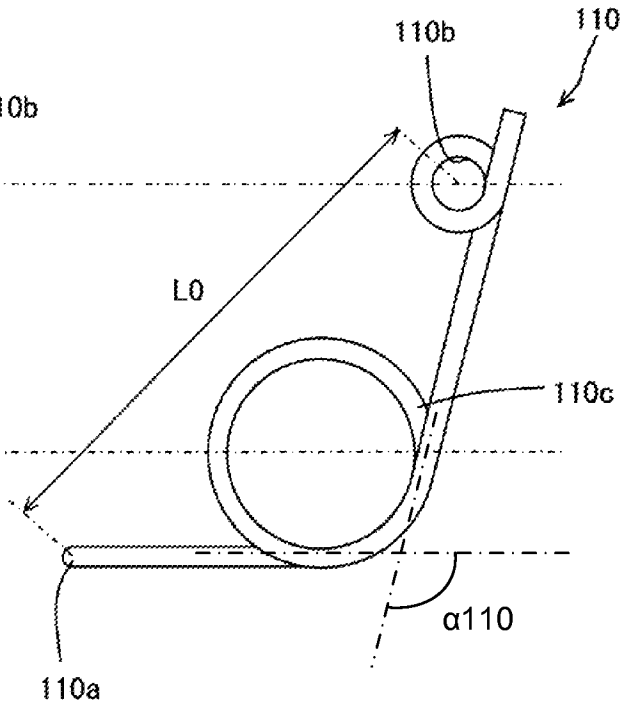
FIG. 7A is a front view of a configuration of a double torsion coil spring.
Figure 7B:
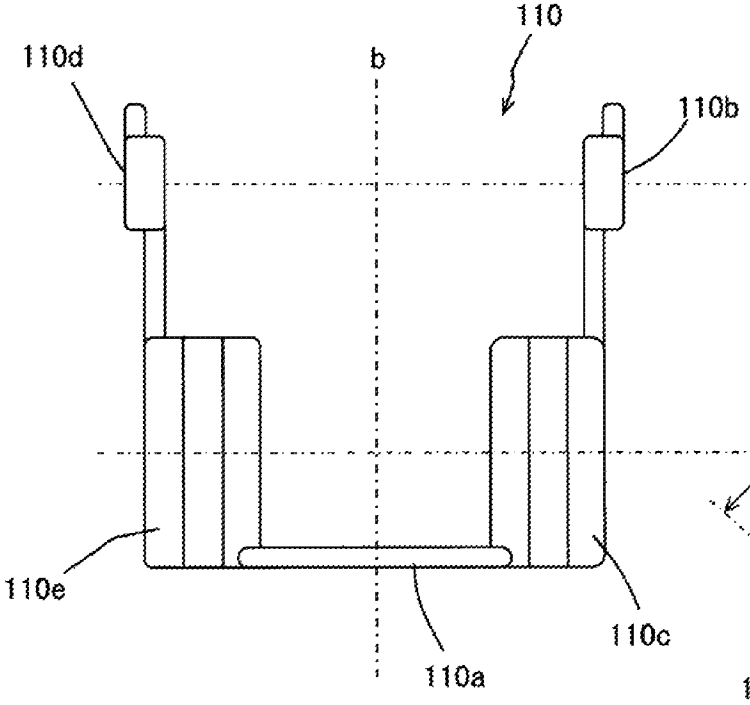
FIG. 7B is a side elevation view of the configuration of the double torsion coil spring from left side.

FIG. 7A is a front view of a configuration of the double torsion coil spring 104. FIG. 7B is a side elevation view of the configuration of the double torsion coil spring 104 from left side. As illustrated FIG. 4, the double torsion coil spring 110 is rotatably supported by the spring shaft 106 of the swing support member 104.

The double torsion coil spring 110 is substantially symmetrically formed about a center line b. The double torsion coil spring 110 includes winding parts 110*c* and 110*e* formed on both sides thereof with the engagement part 110*a* (elastic part) therebetween. The engagement part 110*a* as a first part is formed in a crank shape at one end sides of the winding parts 110*c* and 110*e* as shown in FIG. 4B. On the other hand, other end sides of the winding parts 110*c* and 110*e* respectively include shaft holes 110*b* and 110*d* as second parts formed in the vicinity of front edge parts of the winding parts 110*c* and 110*e*. The other end sides and the one end sides of the winding parts 110*c* and 110*e* are formed with an obtuse angle ($\alpha$110) therebetween, respectively. At this time, a length between the engagement part 110*a* (more specifically, the leading edge of the part 110*a*) and a center of the shaft hole 110*b* (110*d*) is L0 when they are in a natural status (i.e., umcompressed status).

Next, operations of the pull-in part 100 and the engagement member 55 mounted in the image forming apparatus 1 are explained. The pull-in part 100 includes the guide member 101, the double torsion coil spring 110 and members that support the guide member 101 and the double torsion coil spring 110.

Figure 8A:
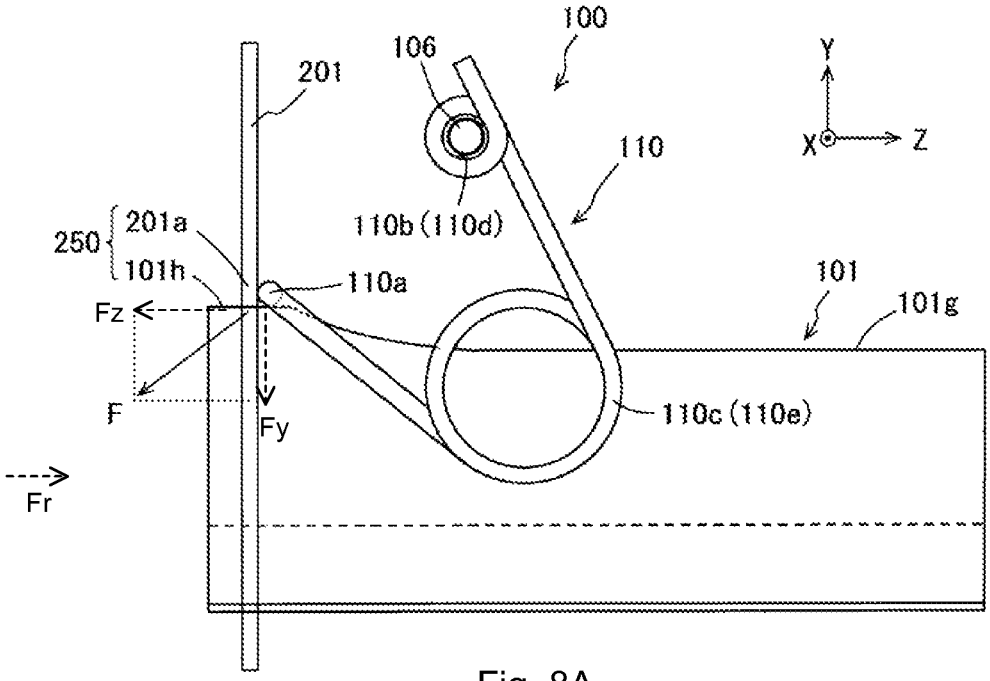
FIG. 8A illustrates a wait status of the pull-in part when the sheet supply cassette moves to a pull-out position illustrated by dotted lines in FIG. 2 in the first embodiment.

FIG. 8A illustrates a wait status (first status) of the pull-in part 100 when the sheet supply cassette 50 moves to the pull-out position illustrated by the dotted lines in FIG. 2. In the wait status, the double torsion coil spring 110 is rotatably supported by the spring shaft 106 that have inserted into the pair of shaft holes 110*b* and 110*d* while the engagement part 110*a* has been guided to the second horizontal part 101*h* of the guide member 101, abuts on, is restricted the movement thereof, and is compressed by the fixing member 201. Accordingly, in the wait status, the double torsion coil spring 110 waits in a state illustrated in the FIG. 8A while the double torsion coil spring 110 generates a bias force in an arrow F direction. In details, the bias force F is resolved into one bias element Fz in Z direction and the other bias element Fy in Y direction. In a case where the bias element Fz is greater than a maximum static frictional force Fr that is created between the sheet supply cassette 50 and the apparatus main body, the cassette 50 is able to move only with the bias element Fz toward the pull-out direction (C direction) regardless of the static frictional force Fr. With this function, the cassette 50 is prevented to some degrees from stopping in a middle of a travel toward the pull-out position, providing a user friendly handling. A minimal requirement to achieve the function is that a maximum bias element Fz which is generated while the sheet supply cassette 50 moves from a dead center position to a first state (discussed later) is greater than a maximum static frictional force Fr. Only for ease of understanding, the direction of Fr is illustrated in FIG. 8A.

Namely, the movement of the engagement part 110*a* of the double torsion coil spring 110 is restricted by a position restriction part 250 in the state. The position restriction part 250 is configured with the second horizontal part 101*h* of the guide member 101 and a contact part 201*a* of the fixing member 201. As described below, the engagement part 110*a* is ready to engage with the groove part 55*h* (FIG. 5A) of the engagement member 55 of the sheet supply cassette 50. The engagement member 55 moves toward the installation position.

Figure 8B:
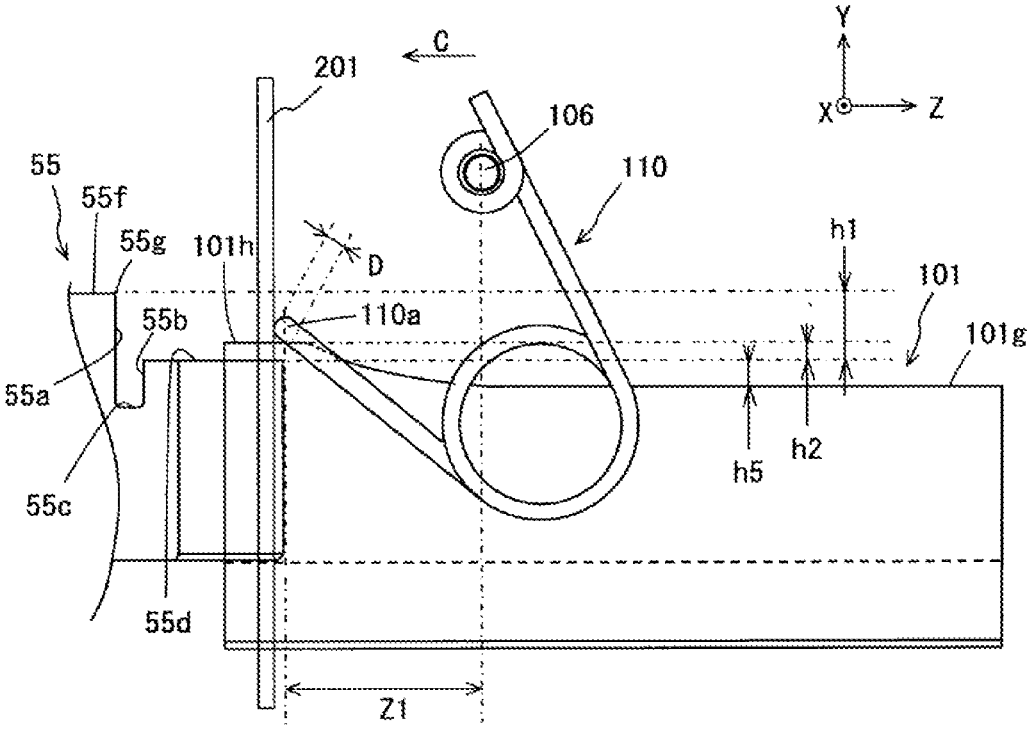
FIG. 8B illustrates a status of the front edge part of the engagement member that starts to insert into a groove part of the guide member in the first embodiment.

FIG. 8B illustrates a status of the front edge part of the engagement member 55 that starts to insert into the groove part 101*a* (FIG. 6B) of the guide member 101 when the sheet supply cassette 50 moves in the arrow D direction from the pull-out position illustrated by the dotted lines in FIG. 2. As illustrated in FIG. 8B, the second horizontal part 101*h* of the guide member 101 is an interval h2 higher than the upper flat surface 55*d* of the engagement member 55 in a height direction (Y axis direction). Namely, the upper flat surface 55*d* is arranged to be more separated from the engagement part 110*a* in the wait status at h2 in the height direction than the second horizontal part 101*h*.

The interval h2 is arranged with respect to the difference h1 between the upper flat surface 55*d* of the engagement member 55 and a highest part 55*g* (here, corresponds to the upper flat surface 55*f*) of the engagement surface 55*a* as follows:

$$h1>h2>0.$$

Namely, the second horizontal part 101*h* of the guide member 101 is positioned between the upper flat surface 55*d* and the highest part 55*g* in the height direction.

As illustrated in FIG. 8B, in the wait status, the engagement part 110*a* of the double torsion coil spring 110 is arranged to abut on the engagement surface 55*a* of the engagement member 55 in a region Z1 in the Z axis direction. The region Z1 is closer to the arrow C side than the spring shaft 106 as a swing shaft of the double torsion coil spring 110. The Z axis direction is a direction in which the sheet supply cassette 50 moves.

By configuring as described above, the engagement member 55 is guided in the pull-in part 100 when the sheet supply cassette 50 moves in the arrow D direction from the pull-out position illustrated by the dotted lines in FIG. 2.

As illustrated in FIG. 8B, the first horizontal part 101*g* of the guide member 101 is an interval h5 higher than the upper flat surface 55*d* of the engagement member 55 in the height direction (Y axis direction). The relationship between h5 and D is as follows:

$$h5>D/2$$

where D represents a diameter of the engagement part 110*a* of the double torsion coil spring 110 due to later-discussed reasons.

Figure 9A:
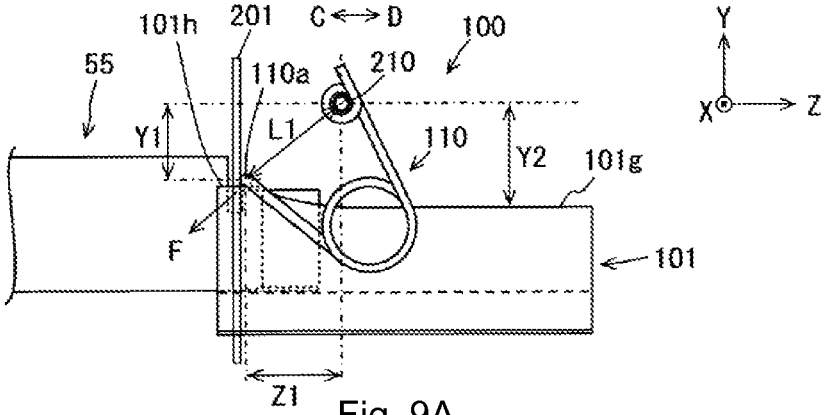
FIG. 9A to C are operation explanatory diagrams of an operation status of the pull-in part when the sheet supply cassette moves from the pull-out position illustrated by the dotted lines in FIG. 2 to an installation position illustrated by solid lines in FIG. 2 in the first embodiment.
Figure 9B:
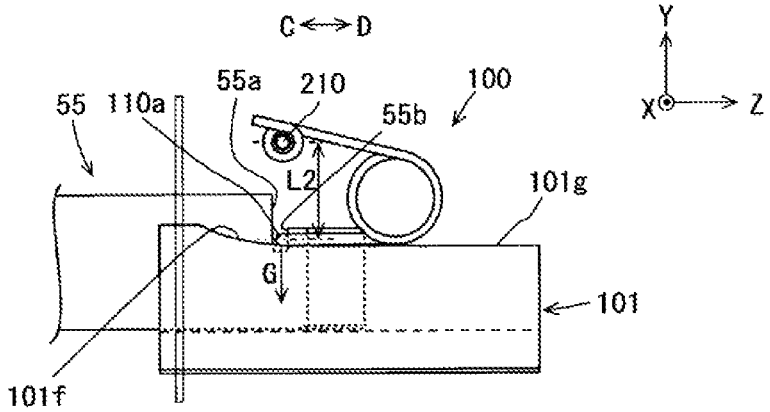
Figure 9C:
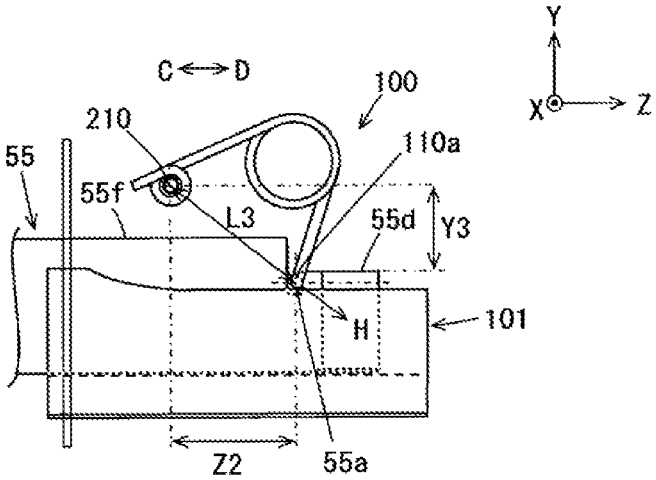

FIGS. 9A to C are operation explanatory diagrams of an operation status of the pull-in part 100 when the sheet supply cassette 50 moves in the arrow D direction from the pull-out position illustrated by the dotted lines in FIG. 2 to the installation position illustrated by the solid lines in FIG. 2. The operation of the pull-in part 100 is explained with reference to FIGS. 9A to C (operation explanatory diagrams).

The pull-in part 100 is configured as explained in FIG. 8B. Therefore, in FIGS. 9A to C, the relationship among heights Y1, Y2 and Y3 is as follows:

$$Y2>Y3>Y1$$

where Y1 is a height from a swing center 210 of the double torsion coil spring 110 to the engagement part 110*a* of the double torsion coil spring 110 when the double torsion coil spring 110 waits illustrated in FIG. 9A; Y2 is a height from the swing center 210 of the double torsion coil spring 110 to each of the pair of first horizontal parts 101*g* of the guide member 101; and Y3 is a height from the swing center 210 of the double torsion coil spring 110 to the upper flat surface 55*d* of the engagement member 55 of the sheet supply cassette 50. Accordingly, the engagement member 55 inserts into the groove part 101*a* (see FIG. 6B) of the guide member 101, and the engagement surface 55*a* abuts on the engagement part 110*a* of the double torsion coil spring 110.

In the wait status illustrated in FIG. 9A, the engagement part 110*a* of the double torsion coil spring 110 generates the bias force F in the arrow F direction while the engagement part 110*a* thereof abuts on, stops at, and is compressed by the guide member 101 and the fixing member 201. From the status, when the engagement member 55 moves in the arrow D direction with the movement of the sheet supply cassette 50, the engagement surface 55*a* thereof abuts on the engagement part 110*a* of the double torsion coil spring 110. When the sheet supply cassette 50 further moves in the arrow D direction, the engagement surface 55*a* thereof resists the bias force F of the double torsion coil spring 110, moves the engagement part 110*a* in the arrow D direction, and the engagement part 110*a* reaches a dead center position below the swing center 210 in a vertical direction. FIG. 9B illustrates a dead center position status (one embodiment of second status) in which the engagement part 110*a* has reached the dead center position. The dead center status and position are defined as status and position where the bias force G is applied only in minus Y direction that is perpendicular to Z and X directions.

During the movement, the engagement part 110*a* moves while the engagement part 110*a* is guided by the second horizontal part 101*h*, the incline part 101*f* and the first horizontal part 101*g* of the guide member 101. The engagement part 110*a* is enclosed by the other engagement surface 55*b* of the groove part 55*h* (see FIG. 5) of the engagement member 55, and is accommodated in the groove part 55*h* while the engagement part 110*a* travels downwardly along the incline part 101*f*.

At the dead center position, since a bias force G of the double torsion coil spring 110 works on the first horizontal part 101*g* that guides the engagement part 110*a* in the vertical direction, a bias force Fz (see FIG. 8A) becomes zero in the direction of the movement of the engagement part 110*a*. When the engagement part 110*a* further moves from the dead center position to the downstream side in the arrow D direction, a component force of a bias force of the double torsion coil spring 110 acts on in the arrow D direction by the movement thereof in the arrow D direction. Thereby, the engagement part 110*a* thereof presses the other engagement surface 55*b* of the engagement member 55.

Thereby, the sheet supply cassette 50 moves in the arrow D direction only by a pressing force of the bias force of the double torsion coil spring 110 or by a resultant force of the pressing force and a force of the user that pushes the sheet supply cassette 50. The installation positioning surface 58 (FIG. 2) of the cassette cover 52 reaches the installation position in which the installation positioning surface 58 abuts on the abutment part 202 (FIG. 2) fixed to the image forming apparatus 1 main body. FIG. 9C illustrates the installation status (third status) in which the pull-in part 100 grasps the engagement member 55 at this time. Herein, directions toward which the engagement member 110*a* swings, which are illustrated from FIG. 9A to FIG. 9C, are defined as a first direction. Y direction means a displacement direction of the engagement part 110*a* (or a direction along which the first part of the biasing member moves). X direction means an axis direction of the swing shaft. Z direction means (C-D directions) means a direction along which the sheet cassette moves. More specifically, +Z direction (or D direction) may be defined as an installation direction and −Z direction (or C direction) may be defined as a pull-out direction of the sheet cassette.

At this time, since a component force of the bias force H of the double torsion coil spring 110 acts on in the arrow D direction, the double torsion coil spring 110 transits into a status in which the engagement part 110*a* of the double torsion coil spring 110 biases the engagement surface 55*b* of the engagement member 55 in the arrow D direction, and positions the cassette cover 52 at the installation position illustrated by the solid lines in FIG. 2.

The relationship among distances L0, L1, L2 and L3 is as follows:

$$L0>L1>L2 \text{ and } L0>L3>L2$$

where

L1 is a distance between the swing center 210 of the double torsion coil spring 110 and the engagement part 110*a* of the double torsion coil spring 110 in the wait status illustrated in FIG. 9A; L2 is a distance between the swing center 210 of the double torsion coil spring 110 and the engagement part 110*a* of the double torsion coil spring 110 in the dead center position status illustrated in FIG. 9B; L3 is a distance between the swing center 210 of the double torsion coil spring 110 and the engagement part 110*a* of the double torsion coil spring 110 in the installation status illustrated in FIG. 9C; and L0 is a distance between the swing center 210 of the double torsion coil spring 110 and the engagement part 110*a* of the double torsion coil spring 110 in the natural status. Sizes of L1 and L3 are configured so that the distance between L1 and L2 and the distance between L3 and L2 are small as much as possible in order to improve the handling during transitions from the wait status to the installation status and the installation status to the wait status, respectively.

An operation of the pull-in part 100, when the sheet supply cassette 50 is pulled out, is opposite to that when the sheet supply cassette 50 is moved in the installation direction described above. Namely, the user needs to resist the bias force of the double torsion coil spring 110 and to pull out the sheet supply cassette 50 from the installation status in FIG. 9C to the dead center position status in FIG. 9B. However, after that, the user pulls out the sheet supply cassette 50 to the wait position in FIG. 9A only with a bias force of the double torsion coil spring 110 in the arrow C direction, or the user receives the force and pulls out the sheet supply cassette 50 to the wait position.

As explained above, when the user installs the sheet supply cassette 50, the user pushes the sheet supply cassette 50 from the pull-out position illustrated by the dotted lines in FIG. 2 before the engagement member 55 abuts on the double torsion coil spring 110 in the wait status illustrated in FIG. 9A. The user resists the bias force of the double torsion coil spring 110 and further pushes the sheet supply cassette 50 before the engagement part 110*a* overreaches the dead center position illustrated in FIG. 9B. Thereby, the sheet supply cassette 50 is positioned at the installation position. In the meantime, when the user pulls out the sheet supply cassette 50, the user resists the bias force of the double torsion coil spring 110 and pulls out the sheet supply cassette 50 before the engagement member 55 overreaches the dead center position status in FIG. 9B. Thereby, the user pulls out the sheet supply cassette 50 to the wait status illustrated in FIG. 9A. As shown in FIGS. 9A to 9C, the double torsion coil spring 110 (as a bias member) provides a bias force F in the pull-out direction (C) at the pull out position . . . the spring 110 provides another bias force F in the installation direction (D) at the installation position.

In the present embodiment, as illustrated in FIG. 2, the sheet supply cassette 50 is held between the pull-out position (illustrated by the dotted lines in FIG. 2) and the installation position (illustrated by the solid lines in FIG. 2) so that the sheet supply cassette 50 slides in the arrow C and D directions along the Z axis. However, the sheet supply cassette 50 may be configured to be separated and removed from the image forming apparatus 1 main body at the pull-out position.

Moreover, in the present embodiment, as illustrated in FIG. 8B, the bottom part 55*c* of the groove part of the engagement member 55 is configured so that the height of the bottom part 55*c* is lower than that of the first horizontal part 101*g* of the guide member 101. However, the present invention is not limited thereto. The height of the bottom part 55*c* may be configured so that the height of the bottom part 55*c* is the same as or higher than that of the first horizontal part 101*g*. By configuring as described above, the component force of the bias force of the double torsion coil spring 110, which works below, acts on the bottom part 55*c*, and an effect to press the cassette cover 52 below. Thereby, the cassette cover 52 is stably positioned at the installation position.

Figure 10:
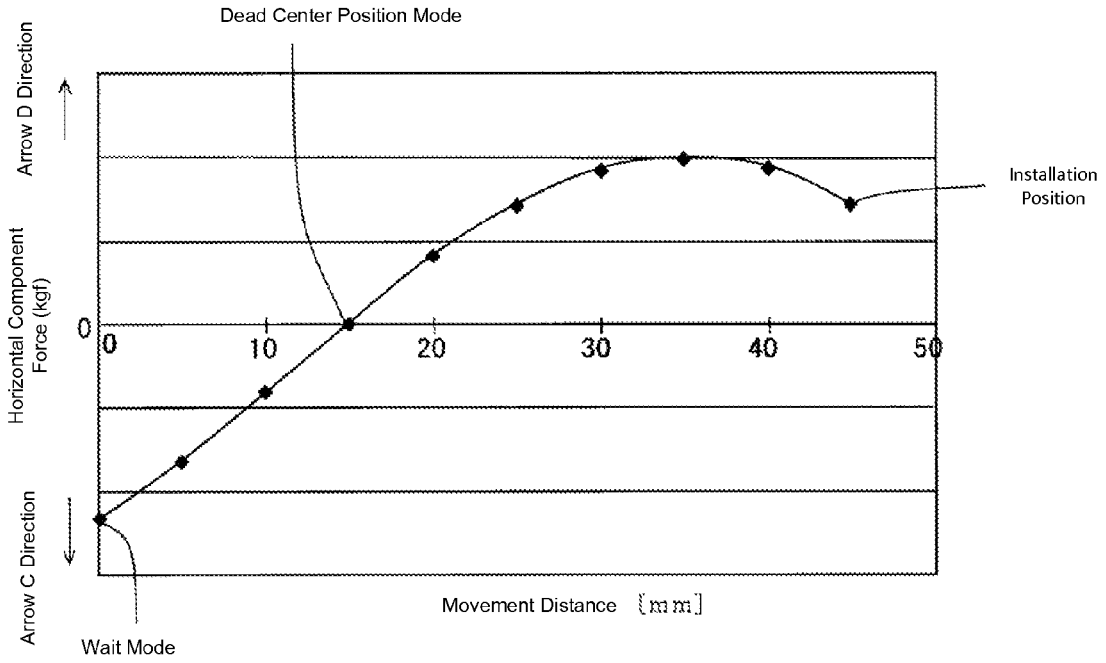
FIG. 10 is a graph illustrating a force generated by the double torsion coil spring in the arrow C and D directions (Z axis direction) is calculated according to the position of the engagement part of the double torsion coil spring in the Z axis direction in the first embodiment.

FIG. 10 is a graph illustrating a force generated by the double torsion coil spring 110 in the arrow C and D directions (Z axis direction). The force is calculated according to the position of the engagement part 110*a* of the double torsion coil spring 110 in the Z axis direction. Z1 is 15 mm, Z2 is 30 mm, and Y2 is 30 mm, which are illustrated in FIGS. 9A to C. Values on the horizontal axis indicate the movement distance of the engagement part 110*a* of the double torsion coil spring 110 from the wait status in the Z axis direction. Values on the vertical axis indicate the horizontal component force of the bias force generated by the double torsion coil spring 110.

The arrow D direction is indicated as plus, and the arrow C direction is indicated as minus.

As illustrated in FIG. 10, a direction of the force generated by the double torsion coil spring 110 is reversed with respect to the directions of the installation and removal of the cassette at the value of 15 mm on the horizontal axis (dead center position status). In the installation status, the force is generated in the direction in which the sheet supply cassette 50 is biased in the installation position. The recording sheets are supplied when the sheet supply cassette 50 is at the installation position. On the other hand, in the wait status, the force is generated in the direction in which the sheet supply cassette 50 is pulled out.

As illustrated in FIG. 9, since the bias force H generated in the installation status biases the sheet supply cassette 50 in the arrow D direction, and biases the sheet supply cassette 50 vertically and below (minus direction of the Y axis) at the same time, the sheet supply cassette 50 is accurately held at the installation position in the Y axis direction.

As described above, according to the image forming apparatus of the present embodiment, the sheet supply cassette 50 is positioned at the installation position by the bias force of the double torsion coil spring 110. Therefore, the sheet supply cassette 50 is securely held in the horizontal and vertical directions without especially providing a positioning mechanism. Moreover, when the sheet supply cassette 50 is installed or removed, a bias force assists the installation and removal.

Second Embodiment

Figure 11A:
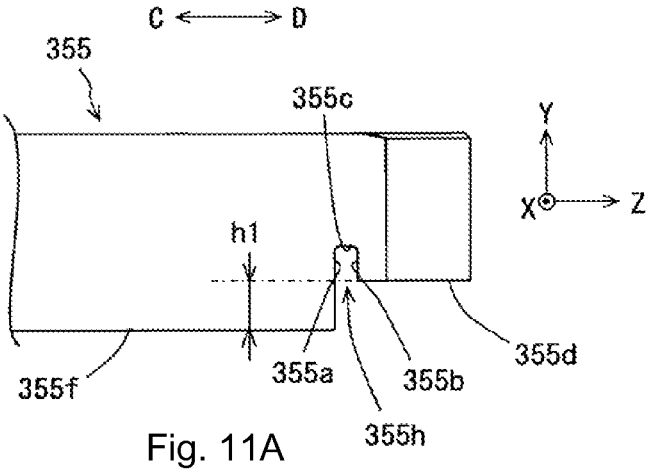
FIG. 11A is a front view of a configuration of an engagement member according to a second embodiment based on the present invention.
Figure 11B:
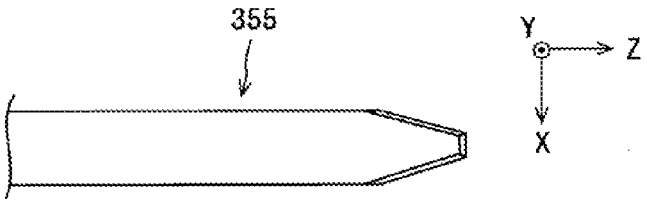
FIG. 11B is a plain view of the configuration of the engagement member according to the second embodiment.
Figure 11C:
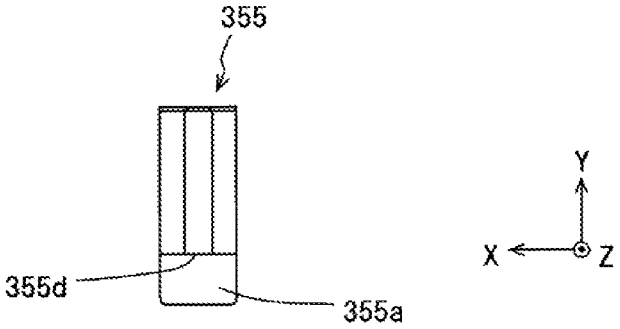
FIG. 11C is a side elevation view of the configuration of the engagement member according to the second embodiment based on the present invention from right side.
Figure 12A:
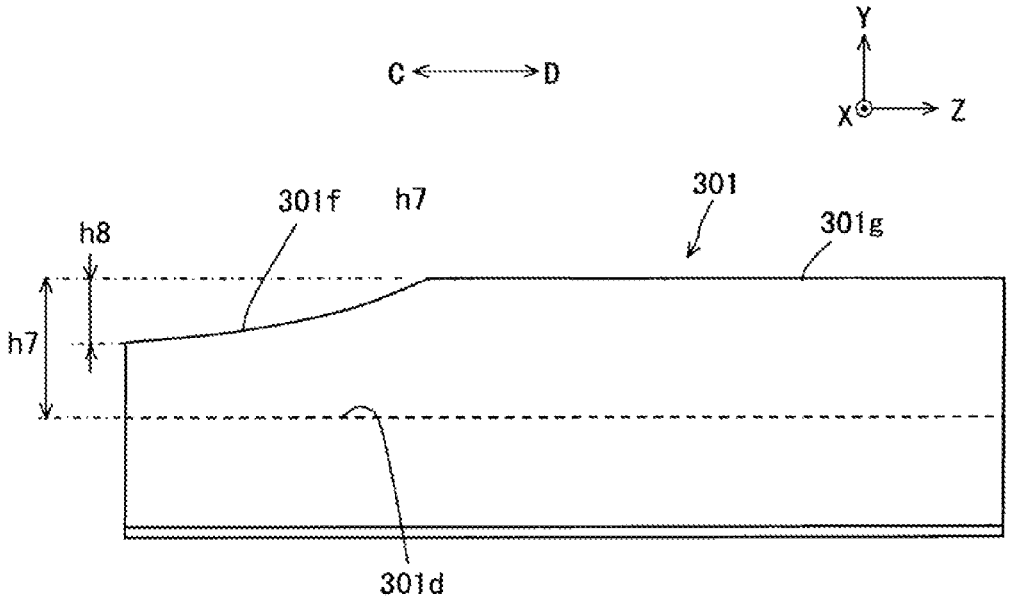
FIG. 12A is a front view of a configuration of a guide member according to the second embodiment.
Figure 13A:
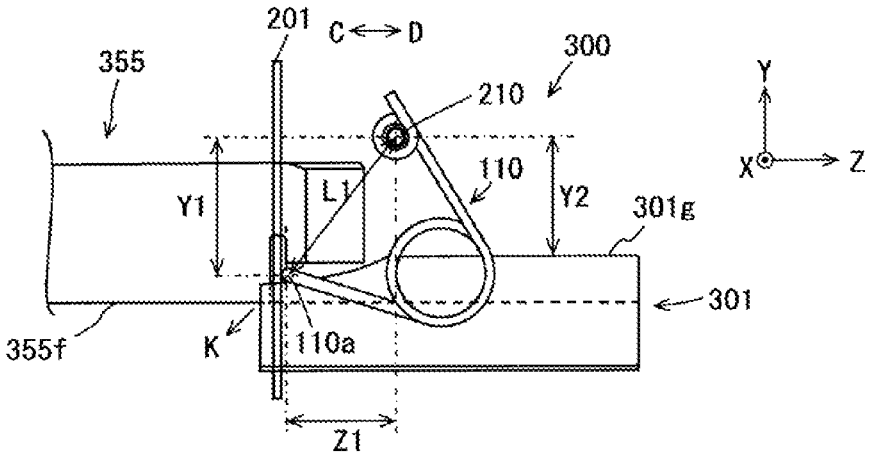
FIG. 13A to C are operation explanatory diagrams of an operation status of a pull-in part in a wait status, a dead center position status and an installation status when the sheet supply cassette moves from the pull-out position illustrated by the dotted lines in FIG. 2 to the installation position illustrated by the solid lines in FIG. 2 in the second embodiment, respectively.
Figure 13B:
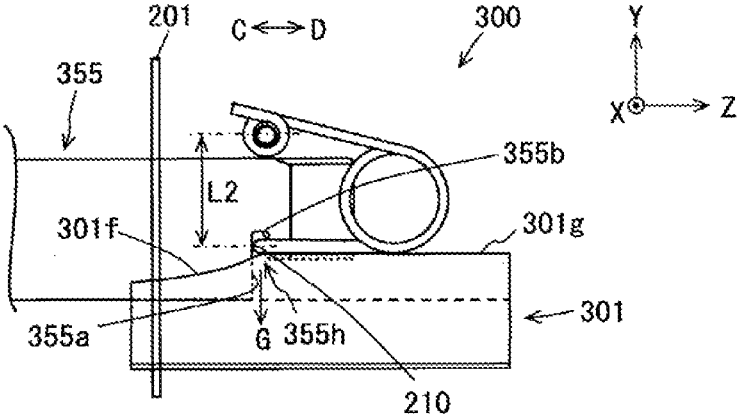
Figure 13C:
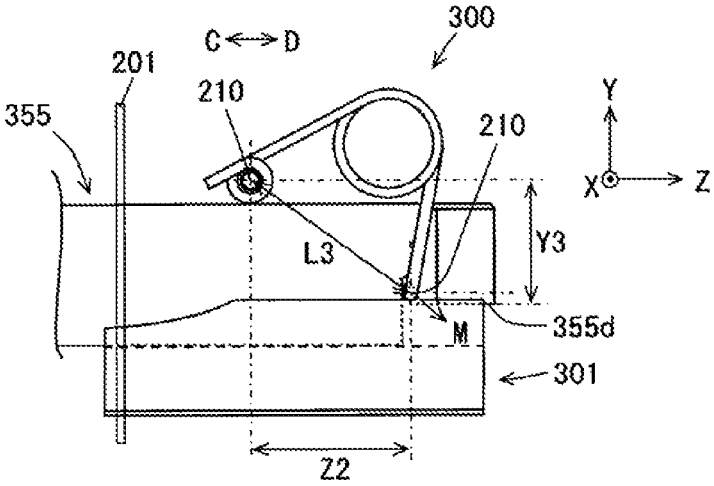

FIGS. 11A to C are views of a configuration of an engagement member 355. The engagement member 355 is employed to an image forming apparatus according to a second embodiment based on the present invention. FIGS. 12A and B are views of a configuration of a guide member 301. The guide member 301 is employed to the image forming apparatus according to the second embodiment based on the present invention. FIGS. 13A to C are operation explanatory diagrams of a pull-in part 300 according to the second embodiment based on the present invention. The pull-in part 300 employees the engagement member 355 and the guide member 301. Shapes of the engagement member 355 and the guide member 301, and an operation of the pull-in part 300 are mainly different from those of the above-described pull-in part 100 of the first embodiment illustrated in FIG. 9.

Accordingly, the same reference numbers are put to, and explanation and figures are omitted for parts of the image forming apparatus employing the pull-in part 300 that are common with the image forming apparatus 1 of the first embodiment described above (see FIG. 1). Parts different from those of the first embodiment are intensively explained. The main configuration of the image forming apparatus of the present embodiment is the same as that of the image forming apparatus 1 of the first embodiment illustrated in FIG. 1 other than the pull-in part 300. Therefore, FIGS. 1 to 4 are referred if needed.

FIG. 11A is a front view of the configuration of the engagement member 355. FIG. 11B is a plain view of the configuration of the engagement member 355. FIG. 11C is a side elevation view of the configuration of the engagement member 355 from right side.

As illustrated in FIG. 11A, the engagement member 355 is symmetrically formed with respect to the above-described engagement member 55 of the first embodiment illustrated in FIG. 5 in the vertical direction. Namely, the engagement member 355 is a substantially cuboid member that extends in the Z axis direction. A groove part 355*h* is formed in the lower side of the engagement member 355 in the vicinity of the front edge part thereof in a width direction (X axis direction). The groove part 355*h* is formed as a border between a lower flat surface 355*f* and an lower flat surface 355*d*. The lower flat surface 355*f* is formed on the engagement member 355 on the arrow C side (sheet supply cassette 50 side). The lower flat surface 355*d* is formed on the engagement member 355 on the arrow D side (front edge side of the engagement member 355). The lower flat surface 355*d* is a predetermined distance h1 higher than the lower flat surface 355*f*. Wedge-shaped both sides of the engagement member 355 in the front edge side narrow along the front edge thereof.

An engagement surface 355*a* (first surface) of the groove part 355*h* is a wall on the arrow C side. An engagement surface 355*b* (second surface) of the groove part 355*h* is a wall on the arrow D side. The engagement surfaces 355*a* and 355*b* face each other through a bottom part 355*c* therebetween, and are formed vertically to the Z axis. As discussed later, when the engagement member 355 moves, the engagement surfaces 355*a* and 355*b* engage with the engagement part 110*a* of the double torsion coil spring 110. The engagement part 110*a* and the engagement surfaces 355*a* and 355*b* act on each other.

Figure 12B:
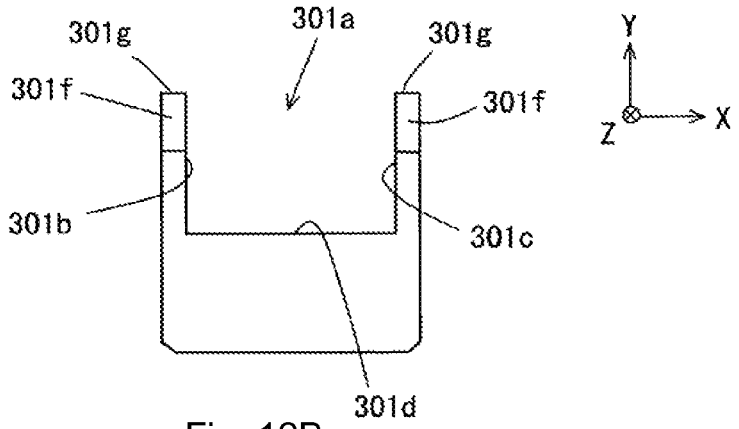
FIG. 12B is a side elevation view of the configuration of the guide member according to the second embodiment from left side.

FIG. 12A is a front view of a configuration of the guide member 301. FIG. 12B is a side elevation view of the configuration of the guide member 301 from left side. The guide member 301 is fixed to and held by the guide support member 107 (see FIG. 4).

As illustrated in FIG. 12B, the guide member 301 includes a cross-sectional surface formed in a C-shape. The left and right guide walls 301*b* and 301*c* as well as the bottom part 301*d* of the guide member 301 form a groove part 301*a*. The engagement member 355 that moves in the arrow D direction inserts into the groove part 301*a* when the sheet supply cassette 50 moves in the installation direction. The engagement member 355 moves on the bottom part 301*d* while the left and right guide walls 301*b* and 301*c* restricts the engagement member 355.

The guide walls 301*b* and 301*c* are opposed to and symmetrically formed with respect to each other. The guide walls 301*b* and 301*c* include a horizontal part 301*g* and an incline part 301*f*, respectively. An upper surface of each horizontal part 301*g* is formed at an h7 height from the bottom part 301*d*, and extends from an edge part on the arrow D direction to a position in which the horizontal part 301*g* exceeds a center part. The incline part 301*f* includes a gentle incline surface that connects an edge part of the horizontal part 301*g* on the arrow C direction and an edge part of each of the guide walls 301*b* and 301*c* on the arrow C direction. The difference between both edge parts of the incline part 301*f* is h8.

FIGS. 13A to C are operation explanatory diagrams of an operation status of the pull-in part 300 when the sheet supply cassette 50 moves in the arrow D direction from the pull-out position illustrated by the dotted lines in FIG. 2 to the installation position illustrated by the solid lines in FIG. 2.

In FIGS. 13A to C, the relationship among heights Y1, Y2 and Y3 is as follows:

$$Y2 > Y3 > Y1$$

where Y1 is a height from a swing center 210 of the double torsion coil spring 110 to the engagement part 110*a* of the double torsion coil spring 110 when the double torsion coil spring 110 waits illustrated in FIG. 13A; Y2 is a height from the swing center 210 of the double torsion coil spring 110 to each of the pair of horizontal parts 301*g* of the guide member 301; and Y3 is a height from the swing center 210 of the double torsion coil spring 110 to the lower flat surface 355*d* of the engagement member 355 of the sheet supply cassette 50. Thereby, the engagement member 355 inserts into the groove part 301*a* (FIG. 12B) of the guide member 301, and the engagement surface 355*a* abuts on the engagement part 110*a* of the double torsion coil spring 110.

The operation of the pull-in part 300 is explained with reference to FIGS. 13A to C (operation explanatory diagrams).

In the wait status illustrated in FIG. 13A, the engagement part 110*a* of the double torsion coil spring 110 generates the bias force K in the arrow K direction while the engagement part 110*a* thereof abuts on, stops at, and is compressed by the guide member 301 and the fixing member 201. From the status, when the engagement member 355 moves in the arrow D direction with the movement of the sheet supply cassette 50, the engagement surface 355*a* thereof abuts on the engagement part 110*a* of the double torsion coil spring 110, resists the bias force K of the double torsion coil spring 110, moves the engagement part 110*a* thereof in the arrow D direction, and the engagement part 110*a* thereof reaches a dead center position below the swing center 210 in a vertical direction. FIG. 13B illustrates a dead center position status in which the engagement part 110*a* has reached the dead center position.

During the movement, the engagement part 110*a* moves while the engagement part 110*a* is guided by the incline part 301*f* and the horizontal part 301*g* of the guide member 301. The engagement part 110*a* is enclosed by the other engagement surface 355*b* of the groove part 355*h* of the engagement member 355, and is accommodated in the groove part 355*h* while the engagement part 110*a* travels upwardly along the incline part 301*f*.

At the dead center position, since a bias force G of the double torsion coil spring 110 works on the horizontal part 301*g* that guides the engagement part 110*a* in the vertical direction, a bias force becomes zero in the direction of the movement of the engagement part 110*a*. When the engagement part 110*a* further overreaches the dead center position, a component force of a bias force of the double torsion coil spring 110 acts on in the arrow D direction by the movement thereof in the arrow D direction. Thereby, the engagement part 110*a* thereof presses the other engagement surface 355*b* of the engagement member 355.

Thereby, the sheet supply cassette 50 moves in the arrow D direction only by the pressing force or by a resultant force of the pressing force and a force of the user that pushes the sheet supply cassette 50. The installation positioning surface 58 (see FIG. 2) of the cassette cover 52 reaches the installation position, and abuts on the abutment part 202 (see FIG. 2) fixed to the image forming apparatus 1 main body. FIG. 13C illustrates the installation status in which the pull-in part 300 grasps the engagement member 355 at this time.

At this time, since a component force of the bias force M of the double torsion coil spring 110 acts on in the arrow D direction, the double torsion coil spring 110 transits into a status in which the engagement part 110*a* of the double torsion coil spring 110 biases the engagement surface 355*b* of the engagement member 355 in the arrow D direction, and positions the cassette cover 52 at the installation position illustrated by the solid lines in FIG. 2.

Moreover, when the double torsion coil spring 110 is in the status in FIG. 13C, the preferable relationship among Fd, μ, and N is as follows:

$$Fd>\mu\cdot N$$

where Fd is the component force of the bias force M of the double torsion coil spring 110 in the arrow D direction; μ is a dynamic friction coefficient between the sheet supply cassette 50 and the holder 31*a* and 31*b* (see FIG. 1); and N is a weight of the sheet supply cassette 50.

Moreover, in order to more securely allow the sheet supply cassette 50 to transit from the status in FIG. 13B into FIG. 13C, the preferable relationship among Fd, μ', and N is as follows:

$$Fd>\mu'\cdot N$$

where μ' is a static friction coefficient between the sheet supply cassette 50 and the holder 31*a* and 31*b* (see FIG. 1).

The relationship among distances L0, L1, L2 and L3 is as follows:

$$L0>L1>L2 \text{ and } L0>L3>L2$$

where L1 is a distance between the swing center 210 of the double torsion coil spring 110 and the engagement part 110*a* of the double torsion coil spring 110 in the wait status illustrated in FIG. 13A; L2 is a distance between the swing center 210 of the double torsion coil spring 110 and the engagement part 110*a* of the double torsion coil spring 110 in the dead center position status illustrated in FIG. 13B; L3 is a distance between the swing center 210 of the double torsion coil spring 110 and the engagement part 110*a* of the double torsion coil spring 110 in the installation status illustrated in FIG. 13C; and L0 is the distance between the swing center 210 of the double torsion coil spring 110 and the engagement part 110*a* of the double torsion coil spring 110 in the natural status. Sizes of L1 and L3 are configured so that the distance between L1 and L2 and the distance between L3 and L2 are small as much as possible in order to improve the handling during transitions from the wait status to the installation status and the installation status to the wait status, respectively.

An operation of the pull-in part 300, when the sheet supply cassette 50 is pulled out, is opposite to that when the sheet supply cassette 50 is moved in the installation direction described above. Namely, the user needs to resist the bias force of the double torsion coil spring 110 and to pull out the sheet supply cassette 50 from the installation status in FIG. 13C to the dead center position status in FIG. 13B. However, after that, the user pulls out the sheet supply cassette 50 to the wait position in FIG. 13A only with a bias force of the double torsion coil spring 110 in the arrow C direction, or the user receives the force and pulls out the sheet supply cassette 50 to the wait position.

As explained above, when the user installs the sheet supply cassette 50, the user pushes the sheet supply cassette 50 from the pull-out position illustrated by the dotted lines in FIG. 2 before the engagement member 355 abuts on the double torsion coil spring 110 in the wait status illustrated in FIG. 13A. The user resists the bias force of the double torsion coil spring 110 and further pushes the sheet supply cassette 50 before the engagement part 110*a* overreaches the dead center position illustrated in FIG. 13B.

Thereby, the sheet supply cassette 50 is positioned at the installation position. In the meantime, when the user pulls out the sheet supply cassette 50, the user resists the bias force of the double torsion coil spring 110 and pulls out the sheet supply cassette 50 before the engagement member 355 overreaches the dead center position status in FIG. 13B. Thereby, the user pulls out the sheet supply cassette 50 to the wait status illustrated in FIG. 13A.

As described above, according to the image forming apparatus of the present embodiment, the sheet supply cassette 50 is positioned at the installation position by the bias force of the double torsion coil spring 110. Therefore, the sheet supply cassette 50 is securely held in the horizontal direction without especially providing a positioning mechanism. Moreover, when the sheet supply cassette 50 is installed or removed, a bias force assists the installation and removal.

Third Embodiment

Figure 14A:
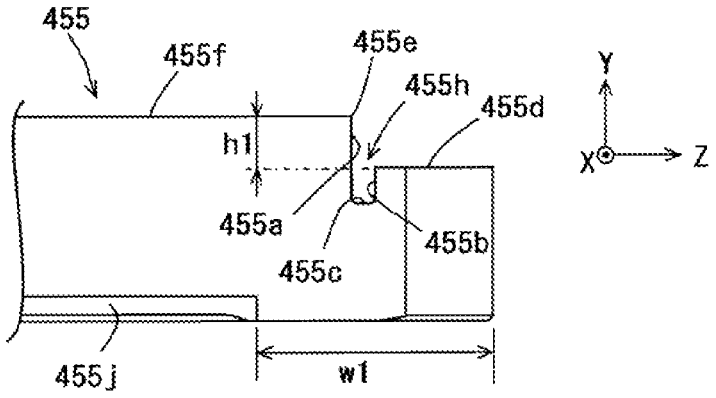
FIG. 14A is a front view of a configuration of an engagement member according to a third embodiment based on the present invention.
Figure 14B:
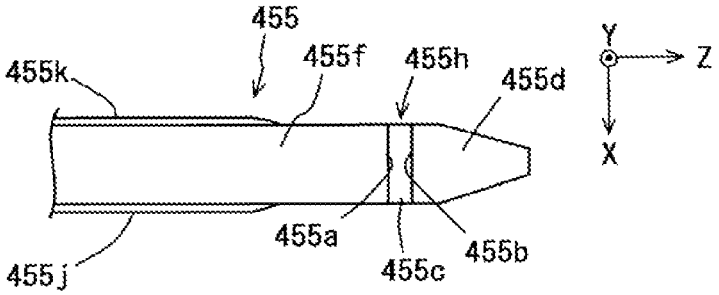
FIG. 14B is a plain view of the configuration of the engagement member according to the third embodiment based on the present invention.
Figure 14C:
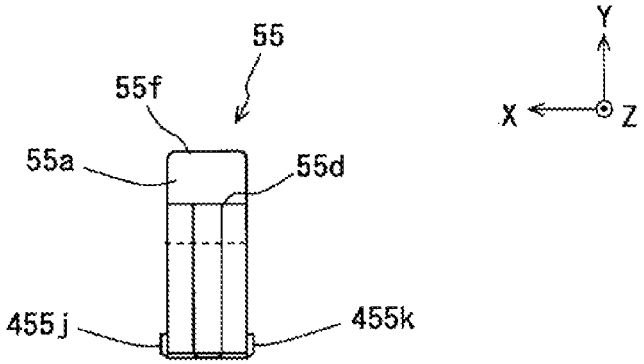
FIG. 14C is a side elevation view of the configuration of the engagement member according to the third embodiment based on the present invention from right side.
Figure 15B:
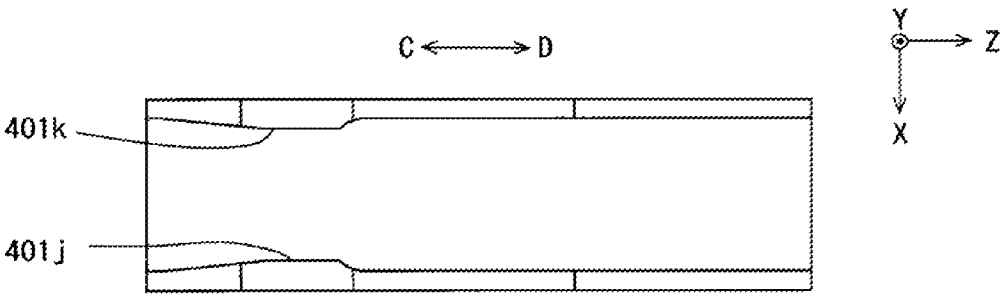
FIG. 15B is a plain view of the configuration of the guide member according to the third embodiment.
Figure 15A:
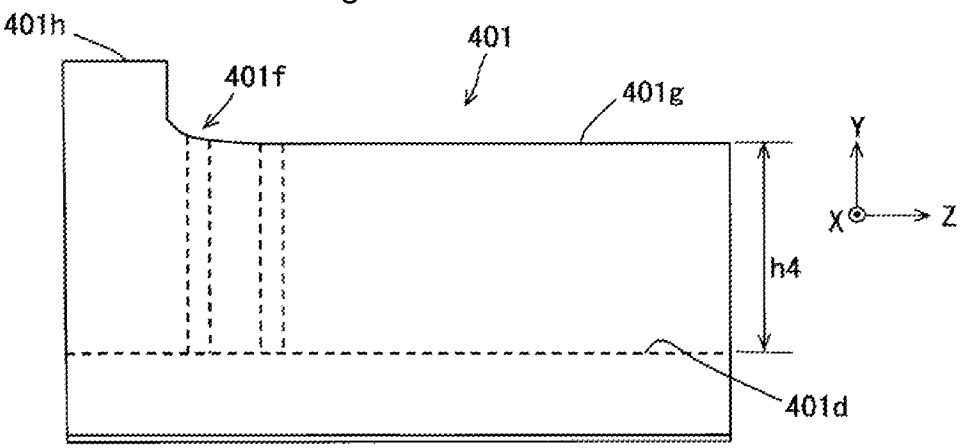
FIG. 15A is a front view of a configuration of a guide member according to the third embodiment.
Figure 15C:
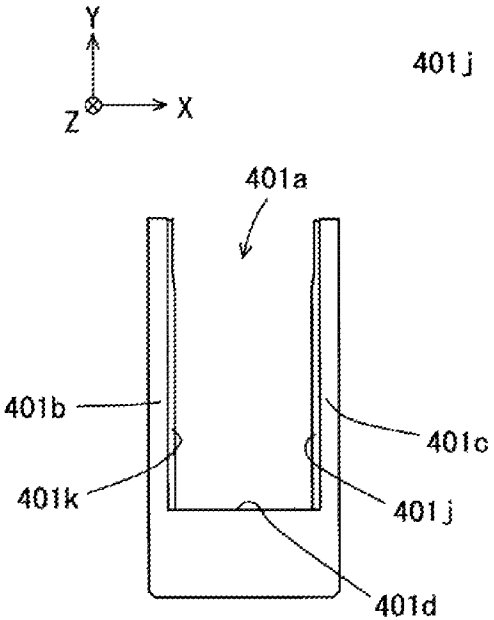
FIG. 15C is a side elevation view of the configuration of the guide member according to the third embodiment from left side.
Figure 16B:
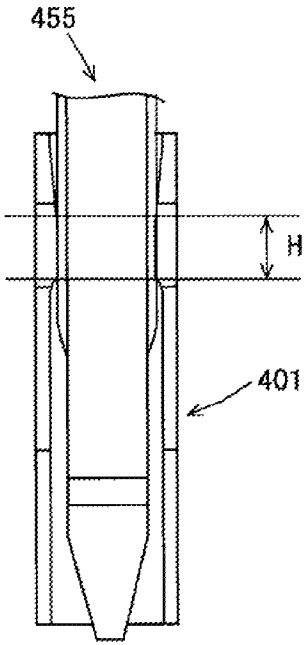
FIG. 16B is an operation explanatory diagram of operations of the guide member and the engagement member according to the third embodiment.
Figure 16A:
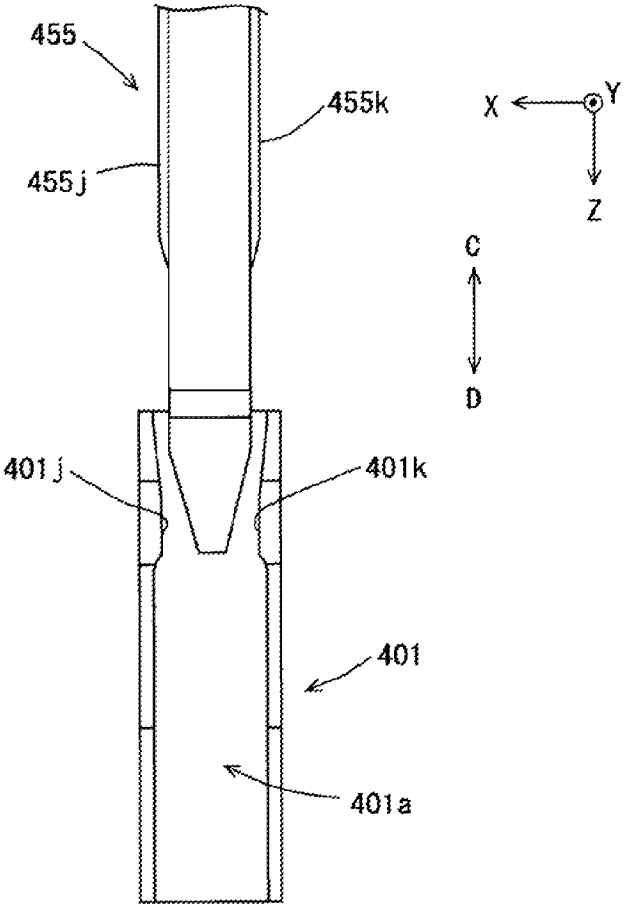
FIG. 16A is an operation explanatory diagram of operations of the engagement member with respect to the guide member according to the third embodiment.

FIGS. 14A to C are views of a configuration of an engagement member 455. The engagement member 455 is employed to an image forming apparatus according to a third embodiment based on the present invention. FIGS. 15A to C are views of a configuration of a guide member 401. The guide member 401 is employed to the image forming apparatus according to the third embodiment based on the present invention. FIGS. 16A and B are operation explanatory diagrams of operations of the engagement member 455 with respect to the guide member 401 according to the third embodiment based on the present invention. The image forming apparatus employees the engagement member 455 and the guide member 401. Only shapes of the engagement member 455 and the guide member 401 are mainly different from those of the above-described image forming apparatus of the first embodiment illustrated in FIG. 1.

Accordingly, the same reference numbers are put to, and explanation and figures are omitted for parts of the image forming apparatus employing the engagement member 455 and the guide member 401 that are common with the first embodiment mentioned above (see FIG. 1). Parts different from those of the first embodiment are intensively explained. The main configuration of the image forming apparatus of the present embodiment is the same as that of the image forming apparatus 1 of the first embodiment illustrated in FIG. 1 other than the pull-in part. Therefore, FIGS. 1 to 4 are referred if needed. In other words, the spring 110 (or biasing member) maintains to provide the bias force against the guide restriction member 101 regardless of its position. For example, the spring 110 provides the bias force at the pull-out position as well as at the installation position. Further, it is preferred that the bias force of the spring 110 at the installation position is greater than a maximum static frictional force of the sheet supply cassette 50 acting on the apparatus main body.

FIG. 14A is a front view of the configuration of the engagement member 455. FIG. 14B is a plain view of the configuration of the engagement member 455. FIG. 14C is a side elevation view of the configuration of the engagement member 455 from right side.

As illustrated FIGS. 14A to C, the engagement member 455 is a substantially cuboid member that extends in the Z axis direction. A groove part 455*h* is formed in the upper side of the engagement member 455 in the vicinity of the front edge part thereof in a width direction (X axis direction). The groove part 455*h* is formed as a border between an upper flat surface 455*f* and an upper flat surface 455*d*. The upper flat surface 455*f* is formed on the engagement member 455 on the arrow C side (sheet supply cassette 50 side). The upper flat surface 455*d* is formed on the engagement member 455 on the arrow D side (front edge side of the engagement member 455). The upper flat surface 455*d* is a predetermined distance h1 lower than the upper flat surface 455*f*. Wedge-shaped both sides of the engagement member 455 in the front edge side narrow along the front edge thereof. An engagement surface 455*a* (first surface) of the groove part 455*h* is a wall on the arrow C side. An engagement surface 455*b* (second surface) of the groove part 455*h* is a wall on the arrow D side. The engagement surfaces 455*a* and 455*b* face each other through a bottom part 455*c* therebetween, and are formed substantially vertically. When the engagement member 455 moves, the engagement surfaces 455*a* and 455*b* engage with the engagement part 110*a* of the double torsion coil spring 110. The engagement part 110*a* and the engagement surfaces 455*a* and 455*b* act on each other.

Projection part 445*j* and 445*k* are formed at the lowest parts of both of side surfaces from an end point to a position separated distance w1 in the Z axis direction from a front edge part of the engagement member 455. The projection parts 445*j* and 445*k* project in the width direction (X axis direction).

FIG. 15A is a front view of a configuration of the guide member 401. FIG. 15B is a plain view of the configuration of the guide member 401 from left side. FIG. 15 C is a side elevation view of the configuration of the guide member 401 from left side. The guide member 401 is fixed to and held by the guide support member 107 (see FIG. 4).

As illustrated in FIG. 15C, the guide member 401 includes a cross-sectional surface formed in a C-shape. The left and right guide walls 401*b* and 401*c* as well as the bottom part 401*d* of the guide member 401 form a groove part 401*a*. The engagement member 455 that moves in the arrow D direction inserts into the groove part 401*a* when the sheet supply cassette 50 moves in the installation direction. The engagement member 455 moves on the bottom part 401*d* while the left and right guide walls 401*b* and 401*c* restricts the engagement member 455.

The guide walls 401*b* and 401*c* are opposed to and symmetrically formed with respect to each other. The guide walls 401*b* and 401*c* include a horizontal part 401*g*, an incline part 401*f* and a lock part 401*h*, respectively. An upper surface of each horizontal part 401*g* is formed at an h4 height from the bottom part 401*d*, and extends from an edge part on the arrow D direction to a position in which the horizontal part 401*g* exceeds a center part. The incline part 401*f* includes an incline surface that is formed to continue from the horizontal part 401*g* and to gently curbs upwardly in the arrow C direction. The lock part 401*h* is formed to continue from the incline part 401*f*.

Moreover, engagement parts 401*j* and 401*k* are formed on the guide walls 401*b* and 401*c*, respectively. The engagement parts 401*j* and 401*k* protrude to face and approach each other along the Z axis direction from a position of the incline part 401*f* that extends in the Z axis direction to an edge part on the arrow C direction.

Operations of the engagement member 455 with respect to the guide member 401 are explained with reference to FIGS. 16A and B (operation explanatory diagrams).

FIG. 16A illustrates a status in which the engagement member 455 starts to enter into the groove part 401*a* of the guide member 401 while the sheet supply cassette 50 moves in the arrow D direction from the pull-out position illustrated by the dotted lines in FIG. 2 to the installation position illustrated by the solid lines in FIG. 2. FIG. 16B illustrates a status in which the sheet supply cassette 50 has reached the installation position.

As illustrated in FIGS. 16A and B obviously, projection parts 455*j* and 455*k* of the engagement member 455 abut on the engagement parts 401*j* and 401*k* of the guide member 401, and the sheet supply cassette 50 is positioned at a position on the X axis direction with respect to the image forming apparatus 1 main body while the engagement member 455 moves in the arrow D direction on the groove part 401*a* of the guide member 401.

As the present embodiment, when the projection parts 455*j* and 455*k* as well as the engagement parts 401*j* and 401*k* are employed to the engagement member 55 and the guide member 101 the above-described first embodiment, for example, the projection parts 455*j* and 455*k* preferably abut on the engagement parts 401*j* and 401*k* in a zone between the dead center position status illustrated in FIG. 9B and an installation status illustrated in FIG. 9C. Namely, the projection parts 455*j* and 455*k* as well as the engagement parts 401*j* and 401*k* are preferably configured to form an installation positioning region H illustrated in FIG. 16B. In the zone, as described above, since the component force of the bias force of the double torsion coil spring 110 acts on in the arrow D direction, a load of sliding during the installation movement by the above-described abutment is lessened.

The position w1 of the projection parts 445*j* and 445*k* from the front edge part of the engagement member 455 illustrated in FIG. 14A are determined after the timing at which the engagement parts 401*j* and 401*k* of the guide member 401 start to abut is considered as described above.

As described above, according to the image forming apparatus of the present invention, the sheet supply cassette 50 is accurately positioned at a position on the X axis direction with respect to the image forming apparatus 1 main body before the sheet supply cassette 50 reaches the installation position. Therefore, the position accuracy at the installation position is improved. Moreover, the load of sliding during the installation movement is lessened.

Fourth Embodiment

Figure 17A:
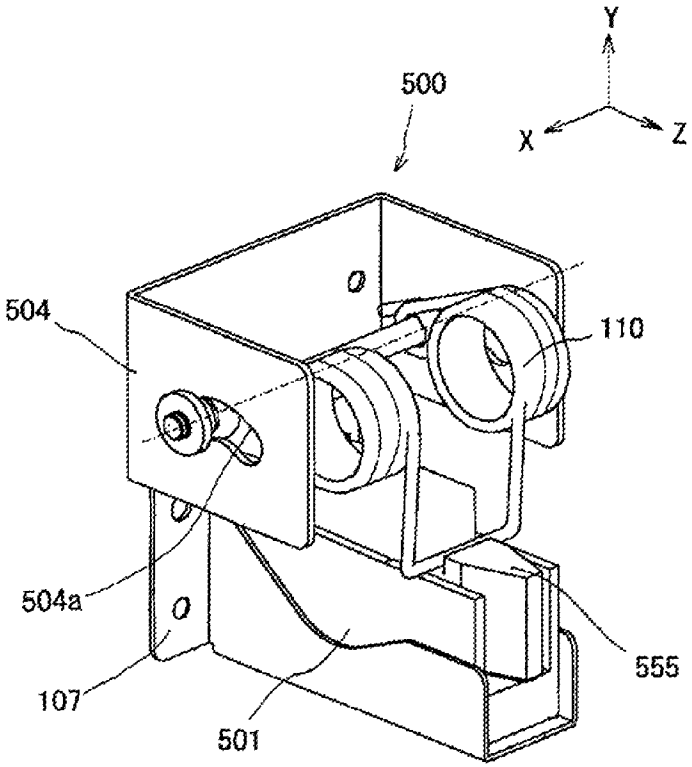
FIG. 17A is a perspective view of configurations of an engagement member and a pull-in part according to a fourth embodiment.
Figure 17B:
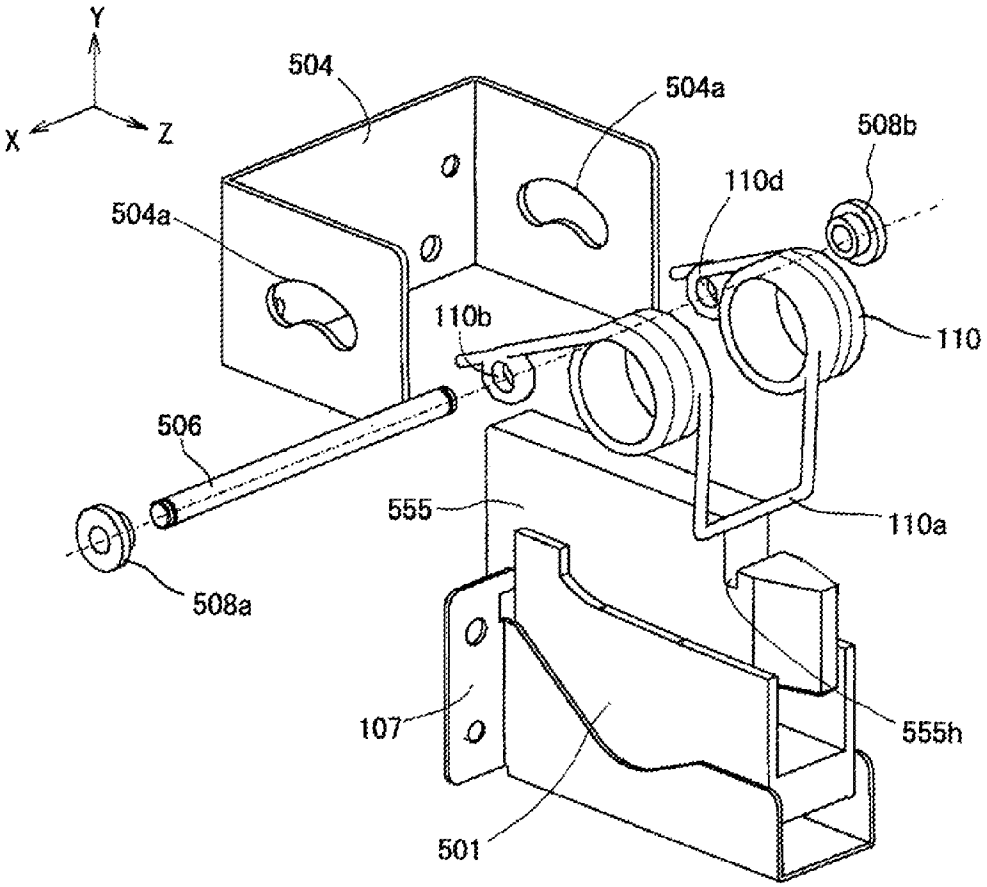
FIG. 17B is an exploded perspective view of the configurations of the engagement member and the pull-in part according to the fourth embodiment.

FIG. 17A is a perspective view of a configuration of a pull-in part 500. FIG. 17B is an exploded perspective view of the configuration of the pull-in part 500. The pull-in part 500 is employed to the image forming apparatus according to a fourth embodiment based on the present invention. Shapes of a swing support member 504, a guide member 501 and an engagement member 555 as well as an operation of the pull-in part 500 are mainly different from those of the above-described pull-in part 100 of the first embodiment illustrated in FIG. 4.

Accordingly, the same reference numbers are put to, and explanation and figures are omitted for parts of the image forming apparatus employing the pull-in part 500 that are common with the image forming apparatus 1 the first embodiment mentioned above (see FIG. 1). Parts different from those of the first embodiment are intensively explained. The main configuration of the image forming apparatus of the present embodiment is the same as that of the image forming apparatus 1 of the first embodiment illustrated in FIG. 1 other than the pull-in part 500. Therefore, FIGS. 1 to 4 are referred if needed.

In FIG. 17, a swing support member 504 and a guide support member 107 formed in a C-shape are fixed to the fixing member 201 (see FIG. 2) fixed to the image forming apparatus 1 main body. A pair of arch holes 504*a* that face each other are formed on surfaces of the swing support member 504 that face each other. Shaft couplings 508*a* and 508*b* are slidably held on both edge part of the spring shaft (support part) 506 by the pair of arch holes 504*a*. The shaft couplings 508*a* and 508*b* are rotatably attached to the spring shaft 506. A double torsion coil spring 110 is rotatably supported by a spring shaft 506. As discussed later, each of the arch holes 504*a* includes a guide center that is formed in an arc shape and has a radius R1. The pair of the arch holes 504*a* guide the shaft couplings 508*a* and 508*b*.

A guide member 501 is fixed to the guide support member 107. As discussed later, the guide member 501 guides the engagement part 110*a* of the double torsion coil spring 110. The engagement part 110*a* engages with the engagement member 555 of the sheet supply cassette 50. The engagement member 555 moves in a groove part 501*a*.

Here, detailed explanation regarding the guide member 501 used in the present embodiment is omitted since the guide member 501 has the same shape as the guide member 401 illustrated in FIG. 15 explained in the above-described third embodiment. As discussed later, the incline part 501*f* is formed in an arc shape and has a radius R2.

Here, detailed explanation regarding the engagement member 555 used in the present embodiment is omitted since the engagement member 555 has the same shape as the engagement member 455 illustrated in FIG. 14 explained in the above-described third embodiment.

Figure 18A:
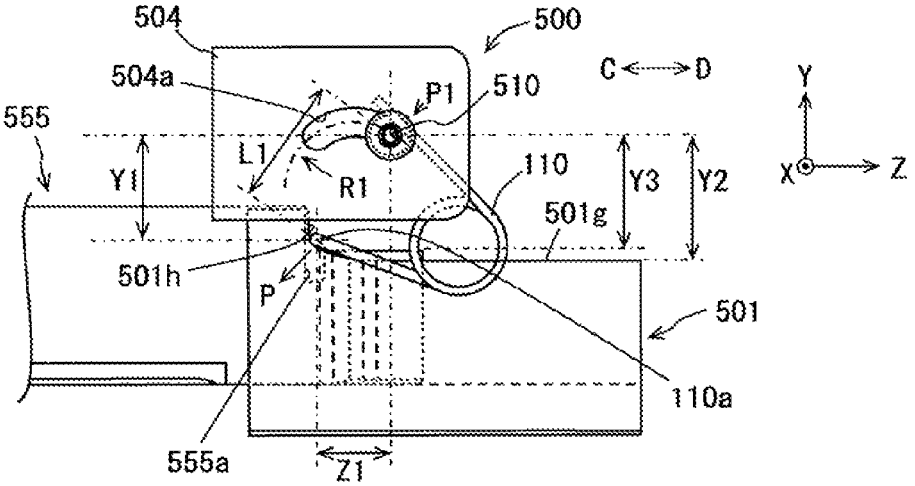
FIG. 18A to C are operation explanatory diagrams of an operation status of the pull-in part in a wait status, a dead center position status and an installation status when the sheet supply cassette moves from the pull-out position illustrated by the dotted lines in FIG. 2 to the installation position illustrated by the solid lines in FIG. 2 in the fourth embodiment, respectively.
Figure 18B:
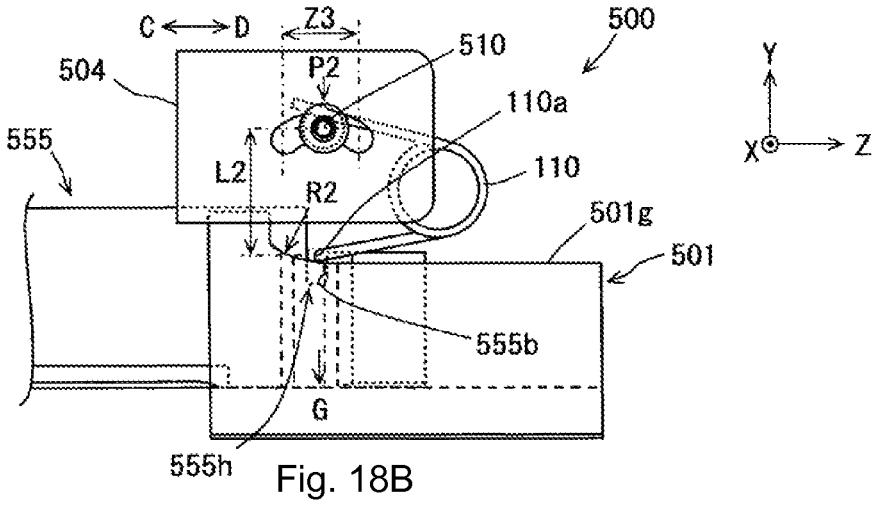
Figure 18C:
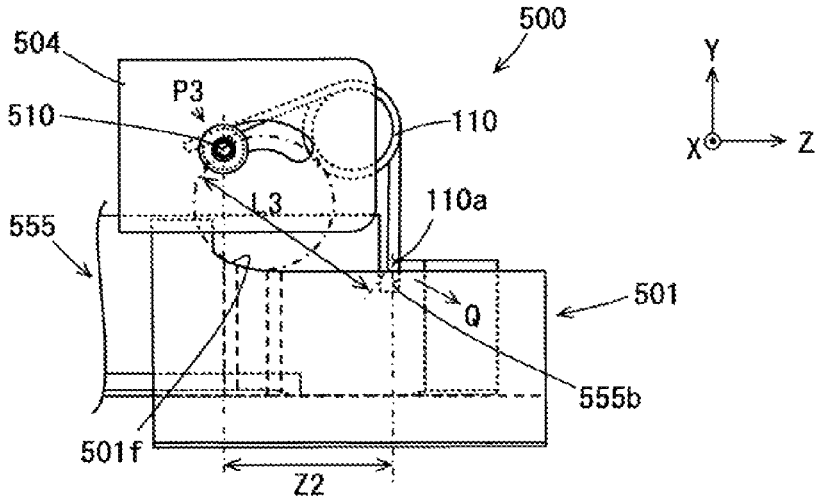

FIGS. 18A to C are operation explanatory diagrams of an operation status of the pull-in part 500 when the sheet supply cassette 50 moves in the arrow D direction from the pull-out position illustrated by the dotted lines in FIG. 2 to the installation position illustrated by the solid lines in FIG. 2.

In FIGS. 18A to C, the relationship among heights Y1, Y2 and Y3 is as follows:

$$Y2>Y3>Y1$$

where Y1 is a height from a swing center 510 of the double torsion coil spring 110 to the engagement part 110*a* of the double torsion coil spring 110 when the double torsion coil spring 110 waits illustrated in FIG. 18A; Y2 is a height from the swing center 510 of the double torsion coil spring 110 to the pair of horizontal parts 501*g* of the guide member 101; and Y3 is a height from the swing center 510 of the double torsion coil spring 110 to the upper flat surface 555*d* of the engagement member 555 of the sheet supply cassette 50.

Thereby, the engagement member 555 inserts into the groove part 501*a* (see FIG. 17B) of the guide member 501, and an engagement surface 555*a* (first surface) abuts on the engagement part 110*a* of the double torsion coil spring 110.

Moreover, the guide center of the arch hole 504*a* of the swing support member 504 and the incline part 501*f* of the guide member 501 are arranged on a concentric circle as illustrated in FIG. 18C. The guide center is formed in an arc shape and has the radius R1. The incline part 501*f* is formed in an arc shape and has the radius R2. Accordingly, the length of the radius R1 is the same as the radius R2.

The operation of the pull-in part 500 is explained with reference to FIGS. 18A to C (operation explanatory diagrams).

In the wait status illustrated in FIG. 18A, the engagement part 110*a* of the double torsion coil spring 110 generates the bias force P in the arrow P direction while the engagement part 110*a* thereof abuts on and stops at the lowest part of the lock part 501*h* of the guide member 501. From the status, when the engagement member 555 moves in the arrow D direction with the movement of the sheet supply cassette 50, the engagement surface 555*a* thereof abuts on the engagement part 110*a* of the double torsion coil spring 110, resists the bias force P of the double torsion coil spring 110, moves the engagement part 110*a* thereof in the arrow D direction, and the engagement part 110*a* thereof reaches a dead center position below the swing center 510 in a vertical direction. FIG. 18B illustrates a dead center position status in which the engagement part 110*a* has reached the dead center position.

The guide center of the arch hole 504*a* and the incline part 501*f* are arranged on the concentric circle. Therefore, while the engagement part 110*a* has reached the dead center position status from the wait status, the engagement part 110*a* is guided by the incline part 501*f*, and moves to a border between a horizontal part 501*g* and the incline part 501*f*. The swing center 510 of the double torsion coil spring 110 moves from an end P1 (first support position) of the arch hole 504*a* illustrated in FIG. 18A to a center part P2 illustrated in FIG.

18B. The swing center 510 corresponds to a position of the spring shaft 506. The center part P2 corresponds to a highest part of the arch hole 504*a*. The engagement part 110*a* and the swing center 510 moves as described above since the compressed double torsion coil spring 110 acts on to return to the natural status.

The relationship between distances L1 and L2 is L1=L2 where L1 is a distance between the swing center 510 of the double torsion coil spring 110 and the engagement part 110*a* of the double torsion coil spring 110 in the wait status illustrated in FIG. 18A; and L2 is a distance between the swing center 510 of the double torsion coil spring 110 and the engagement part 110*a* of the double torsion coil spring 110 in the dead center position status illustrated in FIG. 18B. When the double torsion coil spring 110 moves between P1 and P2, the swing center 510 and the engagement part 110*a* keep the same distance therebetween and the double torsion coil spring 110 do not be compressed. Therefore, a load during the movement from the wait status to the dead center position is lessened. The engagement part 110*a* is enclosed by the other engagement surface 555*b* (second surface) of the groove part 555*h* of the engagement member 555, and is accommodated in the groove part 555*h* while the engagement part 110*a* travels downwardly along the incline part 101*f*.

At the dead center position, since a bias force G of the double torsion coil spring 110 works on the horizontal part 501*g* that guides the engagement part 110*a* in the vertical direction, a bias force becomes zero in the direction of the movement of the engagement part 110*a*. When the engagement part 110*a* overreaches the dead center position, a component force of the bias force of the double torsion coil spring 110 acts on in the arrow D direction by the movement thereof in the arrow D direction. Thereby, while the engagement part 110*a* thereof presses the other engagement surface 555*b* of the engagement member 555, the swing center 510 moves to an other end P3 (second support position) of the arch hole 504*a*.

Therefore, the sheet supply cassette 50 moves in the arrow D direction only by a pressing force of the bias force of the double torsion coil spring 110 or by a resultant force of the pressing force and a force of the user that pushes the sheet supply cassette 50. The installation positioning surface 58 (see FIG. 2) of the cassette cover 52 reaches the installation position, and abuts on the abutment part 202 (see FIG. 2) fixed to the image forming apparatus 1 main body. FIG. 18C illustrates the installation status in which the pull-in part 500 grasps the engagement member 555 at this time.

At this time, since a component force of the bias force Q of the double torsion coil spring 110 acts on in the arrow D direction, the double torsion coil spring 110 transits into a status in which the engagement part 110*a* of the double torsion coil spring 110 biases the engagement surface 555*b* of the engagement member 555 in the arrow D direction, and positions the cassette cover 52 at the installation position illustrated by the solid lines in FIG. 2.

The relationship among distances L0, L1, L2 and L3 is as follows:

$$L0>L3>L1=L2$$

where

L3 is a distance between the swing center 510 of the double torsion coil spring 110 and the engagement part 110*a* of the double torsion coil spring 110 in the installation status illustrated in FIG. 18C.

An action of the operation of the pull-in part 500, when the sheet supply cassette 50 is pulled out, is opposite to that when the sheet supply cassette 50 is moved in the installation direction described above. Namely, the user resists the bias force of the double torsion coil spring 110, and pulls out the sheet supply cassette 50 from the installation status in FIG. 18C to the dead center position status in FIG. 18B. After that, the user receives a weak bias force of the double torsion coil spring 110 in the arrow C direction, and pulls out the sheet supply cassette 50 to the wait position in FIG. 18A.

Figure 19:
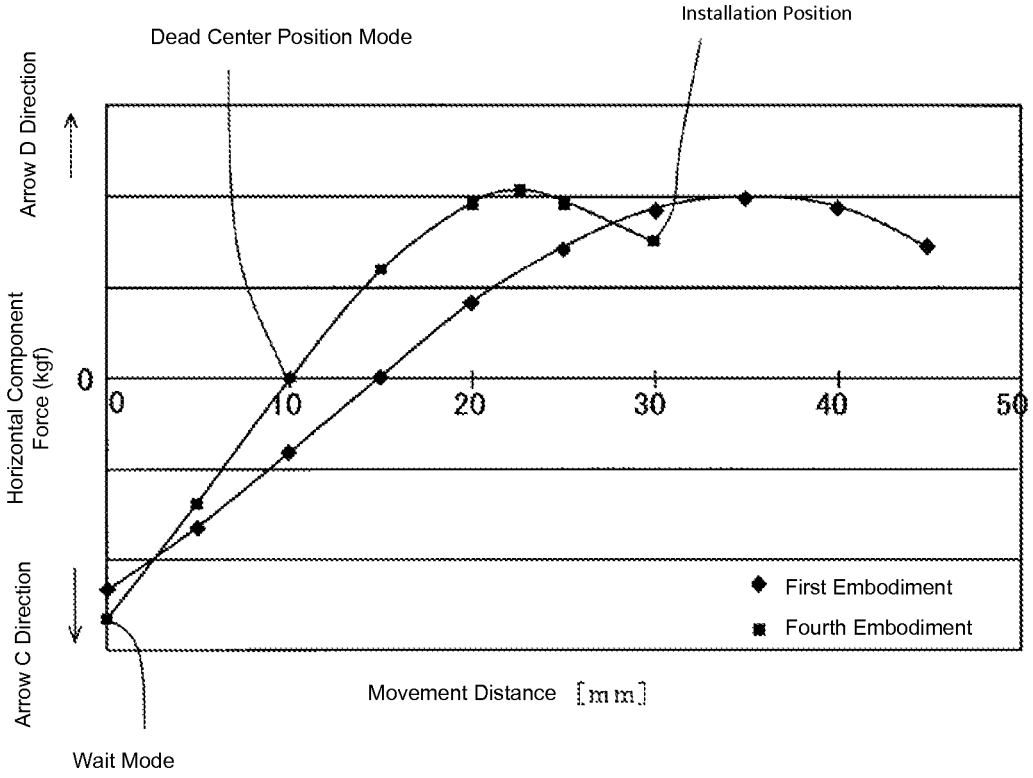
FIG. 19 is a graph illustrating a force generated by the double torsion coil spring in the arrow C and D directions (Z axis direction), the force calculated according to the position of the engagement part of the double torsion coil spring in the Z axis direction in the fourth embodiment.

FIG. 19 is a graph illustrating a force generated by the double torsion coil spring 110 in the arrow C and D directions (Z axis direction). The force is calculated according to the position of the engagement part 110*a* of the double torsion coil spring 110 in the Z axis direction in the present embodiment. Z1 is 15 mm, Z2 is 30 mm and Y2 is 30 mm in the same manner as the above-described first embodiment, and Z3 is 15 mm, which are illustrated in FIGS. 18A to C. Values on the horizontal axis indicate the movement distance of the engagement part 110*a* of the double torsion coil spring 110 from the wait status in the Z axis direction. Values on the vertical axis indicate the horizontal component force of the bias force generated by the double torsion coil spring 110. The arrow D direction is indicated as plus, and the arrow C direction is indicated as minus. For comparison, FIG. 19 also illustrates a graphed example of the force in pull-in part 100 of the first embodiment, which is illustrated in FIG. 10, calculated in the same manner as the fourth embodiment.

As illustrated in FIG. 19, according to the pull-in part 500 according to the present embodiment, a needed space in the Z axis direction from the wait status to the installation status is shorten from 45 mm to 30 mm in comparison with the configuration of the pull-in part 100 according to the first embodiment. The shorten amount is equal to a movement distance Z3 (i.e., 15 mm) of the swing center 510 of the double torsion coil spring 110.

As described above, according to the image forming apparatus of the present embodiment, a stroke from the wait status to the installation status is shorten in the pull-in part. Therefore, a space to install the sheet supply cassette 50 to the image forming apparatus main body and hold the sheet supply cassette 50 in the image forming apparatus main body is shorten. Moreover, a needed work is reduced during the installation and removal of the sheet supply cassette 50.

In each above-mentioned embodiment, the image forming apparatus that uses the four process unit and transfers the toner image on the recording medium with the intermediate transfer belt are explained as an example. However, the present invention is not limited to such an image forming apparatus, and may be implemented in an image forming apparatus that directly transfers a toner image from a process unit onto a recording medium, a monochrome image forming apparatus that uses one process unit, a photocopy machine that uses the image forming apparatuses, and an image forming apparatus included in an automatic manuscript reading device and the like.

Regarding the recording media of the present invention, there is no restriction on quality, size or material. The recording medium may be bond paper, recycled paper, gloss paper, matte paper, over-head-projector (OHP) films, which is made of plastic, or the like. Further, in the application, the recording medium is disclosed as a sheet, but the recording medium may be a roll.

What is claimed is:

1. An image forming apparatus in which a sheet supply cassette configured to stack recording media thereon slidably moves in an installation direction and a pull-out direction so that the sheet supply cassette changes its position between a pull-out position where the sheet supply cassette is pulled out from an apparatus main body and an installation position where the sheet supply cassette is installed to the apparatus main body, the image forming apparatus comprising:

an engagement member provided on the sheet supply cassette;

a biasing member that is configured with a first part formed at an end of the biasing member, a second part formed at another end of the biasing member, and an elastic part provided between the first and second parts, the biasing member applying elastic force, the second part being supported to the apparatus main body with a shaft such that the second part swings around the shaft, the first part engaging with the engagement member so that the biasing member maintains a compressed state by the engagement member; and a guide restriction member provided on the apparatus main body and configured to restrict a movement of the first part in the installation direction and the pull-out direction, wherein during a process in which the sheet supply cassette moves in the installation direction from the pull-out position toward the installation position, the biasing member swings in a first direction by the engagement member, becoming one of a first status through a third status, in the first status, the first part has not engaged with the engagement member, in the second status, the first part engages with the engagement member and moves in the installation direction, in the third status, the sheet supply cassette reaches the installation position and the biasing member biases the engagement member toward the installation position.

2. The image forming apparatus according to claim 1, wherein the guide restriction member includes a position restriction part configured to positionally restrict the first part on an upperstream side of the second part in the installation direction when the sheet supply cassette is at the pull-out position, and when the sheet supply cassette is at the pull-out position, the position restriction part is configured to restrict the biasing member at a position where the first part of the biasing member engages with the engagement member.

3. The image forming apparatus according to claim 2, wherein the engagement member includes a groove part which is configured to engage with the first part and a first surface which is configured to guide the first part to the groove part, and during a process in which the sheet supply cassette moves from the pull-out position toward the installation position, the first part engages with the groove part after contacting the first surface.

4. The image forming apparatus according to claim 3, wherein the biasing member biases the guide restriction member in an engagement direction along which the first part and the groove part are engaged, the guide restriction member includes a guiding part that guides the first part in the engagement direction during the process in which the sheet supply cassette moves from the pull-out position toward the installation position.

5. The image forming apparatus according to claim 4, wherein the guide restriction member includes a first restrict part that restricts the first part at the installation position, and a second restriction part that restricts the first part at the pull-out position, and the guiding part is disposed between the first restriction part and the second restriction part.

6. The image forming apparatus according to claim 5, wherein the biasing member maintains to provide a bias force against the guide restriction member at the pull-out position as well as at the installation position.

7. The image forming apparatus according to claim 1, wherein during another process in which the sheet supply cassette moves in the pull-out direction from the installation position toward the pull-out position, the biasing member becomes the first status from a fourth status which is next to the third status when the sheet supply cassette moves in the pull-out direction from the installation position, the fourth status where the first part that engages with the engagement member moves in the pull-out direction and swings in a second direction that is opposite to the first direction, the engagement member of the sheet supply cassette separates from the first part of the biasing member, further moves in the pull-out direction, and reaches the pull-out position.

8. The image forming apparatus according to claim 7, wherein the first part of the biasing member is displaced in a displacement direction that is orthogonal to both of a sliding direction of the sheet supply cassette and a direction of the shaft during a transition of the biasing member from the first status to the second status and during another transition from the fourth status to the first status.

9. The image forming apparatus according to claim 1, wherein the engagement member includes a first surface on a side of the pull-out position and a second surface on a side of the installation position side that are formed vertically to a sliding direction of the sheet supply cassette and that face each other, and one of the first surface and the second surface abuts on the first part of the biasing member.

10. The image forming apparatus according to claim 1, wherein the engagement member includes a first surface on a side of the pull-out position and a second surface on a side of the installation position side that are formed vertically to a sliding direction of the sheet supply cassette and that face each other, and both of the first surface and the second surface abut on the first part of the biasing member.

11. The image forming apparatus according to claim 1, wherein the guide restriction member restricts a movement of the engagement member in a direction of the shaft when the sheet supply cassette is at the installation position.

12. The image forming apparatus according to claim 1, wherein the second part of the biasing member is supported displacably between a first support position on a side of the installation direction and a second support position on a side of the pull-out direction, during a process in which the biasing member becomes the third status from the first status, a support part of the second part is displaced from the first support position to the second support position.

13. The image forming apparatus according to claim 1, wherein the second part of the biasing member is supported displacably between a first support position on a side of the installation direction and a second support position on a side of the pull-out direction, during a process in which the biasing member becomes the third status from the first status, a support part of the first part is displaced from the first support position to the second support position.

14. An image forming apparatus in which a sheet supply cassette configured to stack recording media thereon slidably moves in an installation direction and a pull-out direction so that the sheet supply cassette changes its position between a pull-out position where the sheet supply cassette is pulled out from an apparatus main body and an installation position where the sheet supply cassette is installed to the apparatus main body, the image forming apparatus comprising:

an engagement member provided on the sheet supply cassette;

a biasing member that is configured with a first part formed at an end of the biasing member, a second part formed at another end of the biasing member, and an elastic part provided between the first and second parts, the biasing member applying elastic force, the second part being supported to the apparatus main body with a shaft such that the second part swings around the shaft, the first part engaging with the engagement member so that the biasing member maintains a compressed state by the engagement member; and a guide restriction member provided on the apparatus main body and configured to restrict a movement of the first part in the installation direction and the pull-out direction, wherein the second part of the biasing member is positioned on an upstream side of the first part of the biasing member in the installation direction when the sheet supply cassette is at the installation position.

15. The image forming apparatus according to claim 14, wherein the guide restriction member includes a position restriction part configured to positionally restrict the first part on an upperstream side of the second part in the installation direction when the sheet supply cassette is at the pull-out position, and the position restriction part is configured to restrict the biasing member at a position where the first part of the biasing member engages with the engagement member, when the sheet supply cassette is at the pull-out position.

16. The image forming apparatus according to claim 15, wherein during a process in which the sheet supply cassette moves in the installation direction from the pull-out position toward the installation position, the biasing member swings in a first direction by the engagement member, becoming one of a first status through a third status, wherein in the first status, the first part has not been engaged with the engagement member, in the second status, the first part engages with the engagement member and moves in the installation direction, in the third status, the sheet supply cassette reaches the installation position and the biasing member biases the engagement member toward the installation position.

17. The image forming apparatus according to claim 14, wherein the engagement member is positioned at a downstream end part in the installation direction of the sheet supply cassette.

18. An image forming apparatus in which a sheet supply cassette configured to stack recording media thereon slidably moves in an installation direction and a pull-out direction so that the sheet supply cassette changes its position between a pull-out position where the sheet supply cassette is pulled out from an apparatus main body and an installation position where the sheet supply cassette is installed to the apparatus main body, the image forming apparatus comprising:

an engagement member provided on the sheet supply cassette;

a biasing member that is configured with a first part formed at an end of the biasing member, a second part formed at another end of the biasing member, and an elastic part provided between the first and second parts, the biasing member applying elastic force, the second part being supported to the apparatus main body with a shaft such that the second part swings around the shaft, the first part engaging with the engagement member so that the biasing member maintains a compressed state by the engagement member; and a guide restriction member provided on the apparatus main body and configured to restrict a movement of the first part in the installation direction and the pull-out direction, wherein the biasing member is configured to generate a bias force in the pull-out direction at the pull-out position, and the biasing member is configured to generate another bias force in the installation direction at the installation position.

19. The image forming apparatus according to claim 18, wherein the guide restriction member includes a position restriction part configured to positionally restrict the first part on an upperstream side of the second part in the installation direction when the sheet supply cassette is at the pull-out position, and the position restriction part is configured to restrict the biasing member at a position where the first part of the biasing member engages with the engagement member, when the sheet supply cassette is at the pull-out position.

20. The image forming apparatus according to claim 19, wherein during a process in which the sheet supply cassette moves in the installation direction from the pull-out position toward the installation position, the biasing member swings in a first direction by the engagement member, becoming one of a first status through a third status, wherein in the first status, the first part has not been engaged with the engagement member, in the second status, the first part engages with the engagement member and moves in the installation direction, in the third status, the sheet supply cassette reaches the installation position and the biasing member biases the engagement member toward the installation position.

* * * * *